US009001165B2

(12) United States Patent
Park et al.

(10) Patent No.: US 9,001,165 B2
(45) Date of Patent: Apr. 7, 2015

(54) METHOD OF OPERATING AN ORGANIC LIGHT EMITTING DISPLAY DEVICE, AND ORGANIC LIGHT EMITTING DISPLAY DEVICE

(71) Applicant: Samsung Display Co., Ltd., Yongin (KR)

(72) Inventors: Jong-Woong Park, Yongin (KR); Won-Woo Jang, Yongin (KR); Joo-Hyung Lee, Yongin (KR)

(73) Assignee: Samsung Display Co., Ltd., Giheung-Gu, Yongin, Gyeonggi-Do (KR)

( * ) Notice: Subject to any disclaimer, the term of this patent is extended or adjusted under 35 U.S.C. 154(b) by 207 days.

(21) Appl. No.: 13/755,248

(22) Filed: Jan. 31, 2013

(65) Prior Publication Data

US 2014/0085170 A1 Mar. 27, 2014

(30) Foreign Application Priority Data

Sep. 27, 2012 (KR) ..... 10-2012-0107532

(51) Int. Cl.

| | |
|---|---|
| ***G09G 5/10*** | (2006.01) |
| ***G09G 3/30*** | (2006.01) |
| ***G09G 3/32*** | (2006.01) |
| ***G09G 5/02*** | (2006.01) |

(52) U.S. Cl.

CPC ..... *G09G 5/02* (2013.01); *G09G 3/3208* (2013.01)

(58) Field of Classification Search

CPC ..... G09G 2320/0673; G09G 2320/0626; G09G 2360/16; G09G 3/2003; G09G 3/3208; G09G 2320/0276

USPC ..... 345/690, 204, 36, 39, 44–46, 76–83, 345/87–102; 315/169.3

See application file for complete search history.

(56) References Cited

U.S. PATENT DOCUMENTS

| | | | | |
|---|---|---|---|---|
| 7,483,011 | B2 * | 1/2009 | Yang et al. | 345/88 |
| 7,656,375 | B2 * | 2/2010 | Lo et al. | 345/88 |
| 8,013,818 | B2 * | 9/2011 | You | 345/87 |

(Continued)

FOREIGN PATENT DOCUMENTS

| | | | |
|---|---|---|---|
| JP | 2007025303 | A | 2/2007 |
| KR | 1020060120766 | A | 11/2006 |
| KR | 1020090092000 | A | 8/2009 |

(Continued)

OTHER PUBLICATIONS

Korean Notice of Allowance issued on Jan. 29, 2014 in connection with Korean Patent Application No. 10-2012-0107532 and Request for Entry of the Accompanying Office Action attached herewith.

*Primary Examiner* — Hong Zhou

(74) *Attorney, Agent, or Firm* — Robert E. Bushnell, Esq.

(57) ABSTRACT

A method of operating an organic light emitting display device including a red sub-pixel, a green sub-pixel, a blue sub-pixel and a white sub-pixel, wherein a first gamma voltage for the red, green and blue sub-pixels and a second gamma voltage for the white pixel are adjusted such that a sum of maximum luminances of the red, green and blue sub-pixels is substantially equal to a luminance of a white color displayed by the organic light emitting display device. With respect to a white portion of input data, a ratio of first data of the red, green and blue sub-pixels to second data of the white sub-pixel is adjusted based on a first accumulated driving amount of the red, green and blue sub-pixels and a second accumulated driving amount of the white sub-pixel.

30 Claims, 16 Drawing Sheets

(56) References Cited

U.S. PATENT DOCUMENTS

2005/0140614 A1* 6/2005 Baek ..... 345/87
2005/0231534 A1* 10/2005 Lee ..... 345/690
2010/0103187 A1* 4/2010 Linssen ..... 345/590
2010/0253664 A1* 10/2010 Byun et al. ..... 345/211
2011/0057950 A1* 3/2011 Kim et al. ..... 345/602

FOREIGN PATENT DOCUMENTS

KR 1020100007748 A 1/2010
KR 1020120094736 A 8/2012

* cited by examiner

METHOD OF OPERATING AN ORGANIC LIGHT EMITTING DISPLAY DEVICE, AND ORGANIC LIGHT EMITTING DISPLAY DEVICE

CLAIM OF PRIORITY

This application makes reference to, incorporates the same herein, and claims all benefits accruing under 35 U.S.C. §119 from an application earlier filed in the Korean Intellectual Property Office on the 27 of Sep. 2012 and there duly assigned Serial No. 10-2012-0107532.

BACKGROUND OF THE INVENTION

1. Field of the Invention

Example embodiments of the inventive concept relate to organic light emitting display devices. More particularly, example embodiments of the inventive concept relate to organic light emitting display devices including red, green, blue and white sub-pixels and methods of operating the organic light emitting display devices.

2. Description of the Related Art

An organic light emitting display device implemented using an red, green and blue (RGB) independent deposition method has various advantages, such as low power consumption and a high contrast ratio (CR) characteristic, etc., and thus the RGB independent deposition method has been widely used. In the RGB independent deposition method, patterning for each color of light is performed using fine metal masks. However, the RGB independent deposition method can be hardly applied to a large scale substrate due to precision problems in aligning the fine metal masks and mask sagging phenomenon as the size of masks increases.

A white organic light emitting diode-color filter (WOLED-CF) method using a white organic light emitting diode in conjunction with a color filter has received much attention in consideration of processability and yield. A white organic light emitting diode can be realized by forming a plurality of organic light emitting materials that respectively emit red, green and blue colors in an organic light emitting layer or by forming complementary pairs of organic light emitting materials in an organic light emitting layer. However, in the WOLED-CF method, white light must be filtered through a color filter, and thus the optical transmittance is relatively low when compared to that of the RGB independent deposition method. In order to maximize the optical efficiency, an RGBW pixel structure including a white (W) sub-pixel having no color filter as well as RGB sub-pixels having color filters has been developed.

However, in an organic light emitting display device having the RGBW pixel structure, since a luminance of a W sub-pixel having no color filter is generally twice higher than a sum of luminances of RGB sub-pixels having color filters, a simultaneous contrast phenomenon that a pure color looks darker because of a bright white background may occur. Further, in the organic light emitting display device having the RGBW pixel structure, since the W sub-pixel is driven more than the RGB sub-pixels, a lifetime of the W sub-pixel may be shorter than that of each RGB sub-pixel, which results in a decrease of a lifetime of the organic light emitting display device.

SUMMARY OF THE INVENTION

Example embodiments provide a method of operating an organic light emitting display device capable of preventing a simultaneous contrast and optimizing lifetimes of sub-pixels.

Example embodiments provide an operating an organic light emitting display device capable of preventing a simultaneous contrast and optimizing lifetimes of sub-pixels.

According to one aspect of example embodiments, there is provided a method of operating an organic light emitting display device including a red sub-pixel, a green sub-pixel, a blue sub-pixel and a white sub-pixel. In the method, a first gamma voltage for the red, green and blue sub-pixels and a second gamma voltage for the white pixel are adjusted such that a sum of maximum luminances of the red, green and blue sub-pixels is substantially equal to a luminance of a white color displayed by the organic light emitting display device, and, with respect to a white portion of input data, a ratio of first data of the red, green and blue sub-pixels to second data of the white sub-pixel is adjusted based on a first accumulated driving amount of the red, green and blue sub-pixels and a second accumulated driving amount of the white sub-pixel.

In example embodiments, the first gamma voltage and the second gamma voltage may be adjusted such that the sum of the maximum luminances of the red, green and blue sub-pixels is substantially equal to a maximum luminance of the white sub-pixel.

In example embodiments, the first gamma voltage may be increased to increase the sum of the maximum luminances of the red, green and blue sub-pixels, and the second gamma voltage may be decreased to decrease the maximum luminance of the white sub-pixel.

In example embodiments, the first gamma voltage may be increased in inverse proportion to a ratio of an aperture size of the red, green and blue sub-pixels to an aperture size of a pixel.

In example embodiments, the second gamma voltage may be decreased in inverse proportion to a ratio of the maximum luminance of the white sub-pixel to the increased sum of the maximum luminances of the red, green and blue sub-pixels.

In example embodiments, to adjust the ratio of the first data to the second data with respect to the white portion of the input data, a ratio of the first accumulated driving amount of the red, green and blue sub-pixels to the second accumulated driving amount of the white sub-pixel may be calculated, and the ratio of the first data of the red, green and blue sub-pixels to the second data of the white sub-pixel with respect to the white portion of the input data may be determined in inverse proportion to the ratio of the first accumulated driving amount to the second accumulated driving amount.

In example embodiments, to calculate the ratio of the first accumulated driving amount to the second accumulated driving amount, the first accumulated driving amount may be calculated by accumulating a product of gray values of the red, green and blue sub-pixels, driving times of the red, green and blue sub-pixels and a ratio of the first gamma voltage after being adjusted to the first gamma voltage before being adjusted, the second accumulated driving amount may be calculated by accumulating a product of a gray value of the white sub-pixel, a driving time of the white sub-pixel and a ratio of the second gamma voltage after being adjusted to the second gamma voltage before being adjusted, and the ratio of the calculated first accumulated driving amount to the calculated second accumulated driving amount may be calculated.

In example embodiments, to calculate the ratio of the first accumulated driving amount to the second accumulated driving amount, a first previous accumulated driving amount of the red, green and blue sub-pixels and a second previous accumulated driving amount of the white sub-pixel may be read from a nonvolatile memory device, the first accumulated driving amount may be calculated by accumulating, in addition to the first previous accumulated driving amount, a product of gray values of the red, green and blue sub-pixels, driving times of the red, green and blue sub-pixels and a ratio of the first gamma voltage after being adjusted to the first gamma voltage before being adjusted, the second accumulated driving amount may be calculated by accumulating, in addition to the second previous accumulated driving amount, a product of a gray value of the white sub-pixel, a driving time of the white sub-pixel and a ratio of the second gamma voltage after being adjusted to the second gamma voltage before being adjusted, and the ratio of the calculated first accumulated driving amount to the calculated second accumulated driving amount may be calculated.

In example embodiments, the nonvolatile memory device may be located at a host device.

In example embodiments, the first previous accumulated driving amount and the second previous accumulated driving amount stored in the nonvolatile memory device may be received from the host device during an initialization operation of the organic light emitting display device.

In example embodiments, the calculated first accumulated driving amount and the calculated second accumulated driving amount may be transmitted to the host device during a termination operation of the organic light emitting display device, and the transmitted first and second accumulated driving amounts may be used as the first and second previous accumulated driving amounts during a subsequent initialization operation.

In example embodiments, the ratio of the first data to the second data with respect to the white portion of the input data may be periodically adjusted.

In example embodiments, to adjust the ratio of the first data to the second data with respect to the white portion of the input data, a number of frames of the input data may be counted, the counted number of frames may be compared with a reference frame number, and when the counted number of frames is the same as the reference frame number, the ratio of the first data to the second data with respect to the white portion of the input data may be adjusted.

According to another aspect of example embodiments, there is provided a method of operating an organic light emitting display device including a red sub-pixel, a green sub-pixel, a blue sub-pixel and a white sub-pixel. In the method, a first gamma voltage for the red, green and blue sub-pixels is increased to increase a sum of maximum luminances of the red, green and blue sub-pixels, a second gamma voltage for the white pixel is decreased to decrease a maximum luminance of the white sub-pixel, a ratio of a first accumulated driving amount of the red, green and blue sub-pixels to a second accumulated driving amount of the white sub-pixel is calculated, a ratio of first data of the red, green and blue sub-pixels to second data of the white sub-pixel with respect to a white portion of RGB input data is determined in inverse proportion to the ratio of the first accumulated driving amount to the second accumulated driving amount, the RGB input data are converted into RGBW data based on the ratio of the first data to the second data with respect to the white portion, and the red, green, blue and white sub-pixels are driven based on the increased first gamma voltage, the decreased second gamma voltage and the RGBW data.

In example embodiments, the first gamma voltage may be increased in inverse proportion to a ratio of an aperture size of the red, green and blue sub-pixels to an aperture size of a pixel.

In example embodiments, the second gamma voltage may be decreased in inverse proportion to a ratio of the maximum luminance of the white sub-pixel to the increased sum of the maximum luminances of the red, green and blue sub-pixels.

In example embodiments, to calculate the ratio of the first accumulated driving amount to the second accumulated driving amount, the first accumulated driving amount may be calculated by accumulating a product of gray values of the red, green and blue sub-pixels, driving times of the red, green and blue sub-pixels and a ratio of the first gamma voltage after being adjusted to the first gamma voltage before being adjusted, the second accumulated driving amount may be calculated by accumulating a product of a gray value of the white sub-pixel, a driving time of the white sub-pixel and a ratio of the second gamma voltage after being adjusted to the second gamma voltage before being adjusted, and the ratio of the calculated first accumulated driving amount to the calculated second accumulated driving amount may be calculated.

In example embodiments, to calculate the ratio of the first accumulated driving amount to the second accumulated driving amount, a first previous accumulated driving amount of the red, green and blue sub-pixels and a second previous accumulated driving amount of the white sub-pixel may be read from a nonvolatile memory device, the first accumulated driving amount may be calculated by accumulating, in addition to the first previous accumulated driving amount, a product of gray values of the red, green and blue sub-pixels, driving times of the red, green and blue sub-pixels and a ratio of the first gamma voltage after being adjusted to the first gamma voltage before being adjusted, the second accumulated driving amount may be calculated by accumulating, in addition to the second previous accumulated driving amount, a product of a gray value of the white sub-pixel, a driving time of the white sub-pixel and a ratio of the second gamma voltage after being adjusted to the second gamma voltage before being adjusted, and the ratio of the calculated first accumulated driving amount to the calculated second accumulated driving amount may be calculated.

In example embodiments, to determine the ratio of the first data to the second data with respect to the white portion of the RGB input data, a number of frames of the RGB input data may be counted, the counted number of frames may be compared with a reference frame number, and when the counted number of frames is equal to the reference frame number, the ratio of the first data to the second data with respect to the white portion of the RGB input data may be adjusted.

According to still another aspect of example embodiments, there is provided a method of operating an organic light emitting display device including a red sub-pixel, a green sub-pixel, a blue sub-pixel and a white sub-pixel. In the method, RGB input data received from a host device are converted into RGBW data, a first gamma voltage for the red, green and blue sub-pixels and a second gamma voltage for the white pixel are adjusted based on a ratio of an aperture size of the red, green and blue sub-pixels to an aperture size of a pixel, a ratio of a maximum luminance of the white sub-pixel to a sum of maximum luminances of the red, green and blue sub-pixels, and a ratio of a first accumulated driving amount of the red, green and blue sub-pixels to a second accumulated driving amount of the white sub-pixel, and the red, green, blue and white sub-pixels are driven based on the adjusted first gamma voltage, the adjusted second gamma voltage and the RGBW data.

In example embodiments, the first gamma voltage may be adjusted in inverse proportion to the ratio of the aperture size of the red, green and blue sub-pixels to the aperture size of the pixel and in inverse proportion to the ratio of the first accumulated driving amount to the second accumulated driving amount.

In example embodiments, the second gamma voltage may be adjusted in inverse proportion to the ratio of the maximum luminance of the white sub-pixel to the sum of the maximum luminances of the red, green and blue sub-pixels and in proportion to the ratio of the first accumulated driving amount to the second accumulated driving amount.

According to further still another aspect of example embodiments, there is provided an organic light emitting display device including a display panel including a red sub-pixel, a green sub-pixel, a blue sub-pixel and a white sub-pixel, a gamma voltage generator configured to generate a first gamma voltage for the red, green and blue sub-pixels and a second gamma voltage for the white pixel, the first and second gamma voltages being adjusted such that a sum of maximum luminances of the red, green and blue sub-pixels is substantially equal to a luminance of a white color displayed by the organic light emitting display device, a data converter configured to adjust, with respect to a white portion of RGB input data, a ratio of first data of the red, green and blue sub-pixels to second data of the white sub-pixel based on a first accumulated driving amount of the red, green and blue sub-pixels and a second accumulated driving amount of the white sub-pixel, and configured to convert the RGB input data into RGBW data based on the adjusted ratio of the first data to the second data, and a source driver configured to drive the red, green, blue and white sub-pixels based on the first gamma voltage, the second gamma voltage and the RGBW data.

In example embodiments, the first gamma voltage and the second gamma voltage generated by the gamma voltage generator may be adjusted such that the sum of the maximum luminances of the red, green and blue sub-pixels is substantially equal to a maximum luminance of the white sub-pixel.

In example embodiments, the first gamma voltage generated by the gamma voltage generator may be increased to increase the sum of the maximum luminances of the red, green and blue sub-pixels, and the second gamma voltage generated by the gamma voltage generator may be decreased to decrease the maximum luminance of the white sub-pixel.

In example embodiments, the first gamma voltage generated by the gamma voltage generator may be increased in inverse proportion to a ratio of an aperture size of the red, green and blue sub-pixels to an aperture size of a pixel, and the second gamma voltage generated by the gamma voltage generator may be decreased in inverse proportion to a ratio of the maximum luminance of the white sub-pixel to the increased sum of the maximum luminances of the red, green and blue sub-pixels.

In example embodiments, the data converter may include a data ratio determining unit configured to determine the ratio of the first data to the second data with respect to the white portion of the RGB input data in inverse proportion to the ratio of the first accumulated driving amount to the second accumulated driving amount, and an RGB-to-RGBW converting unit configured to convert the RGB input data into the RGBW data based on the ratio of the first data to the second data with respect to the white portion of the RGB input data.

In example embodiments, the data ratio determining unit may include a driving amount accumulating unit configured to calculate the first accumulated driving amount by accumulating a product of gray values of the red, green and blue sub-pixels, driving times of the red, green and blue sub-pixels and a ratio of the first gamma voltage after being adjusted to the first gamma voltage before being adjusted, and configured to calculate the second accumulated driving amount by accumulating a product of a gray value of the white sub-pixel, a driving time of the white sub-pixel and a ratio of the second gamma voltage after being adjusted to the second gamma voltage before being adjusted, and a data ratio calculating unit configured to receive the first accumulated driving amount and the second accumulated driving amount from the driving amount accumulating unit, and configured to calculate the ratio of the first data to the second data with respect to the white portion of the RGB input data in inverse proportion to the ratio of the first accumulated driving amount to the second accumulated driving amount.

In example embodiments, the driving amount accumulating unit may be configured to receive the first and second accumulated driving amounts stored in a nonvolatile memory device from a host device during an initialization operation of the organic light emitting display device, and is configured to transmit the first and second accumulated driving amounts to the host device to store the first and second accumulated driving amounts in the nonvolatile memory device during a termination operation of the organic light emitting display device.

In example embodiments, the data converter may include a frame counter configured to count a number of frames of the RGB input data in response to a vertical synchronization signal, and a comparator configured to compare the counted number of frames with a reference frame number, and configured to activate the data ratio determining unit when the counted number of frames is the same as the reference frame number.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings, in which like reference symbols indicate the same or similar components, wherein.

DETAILED DESCRIPTION OF THE INVENTION

Figure 1:
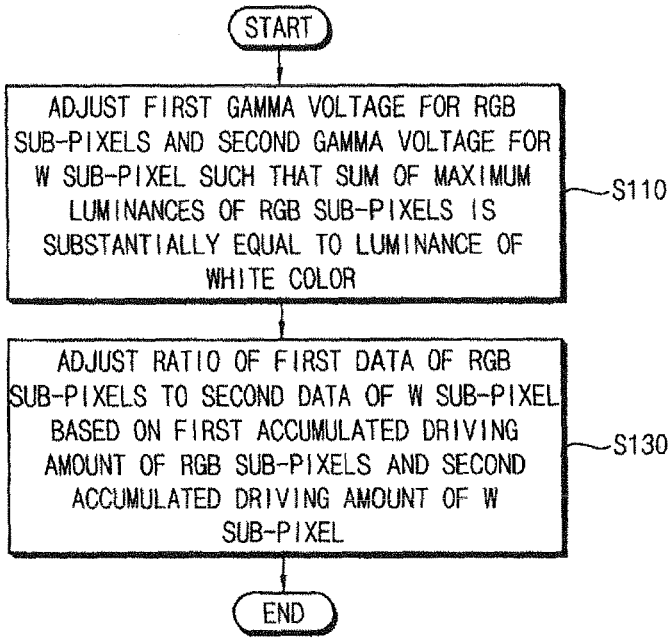
FIG. 1 is a flow chart illustrating a method of operating an organic light emitting display device including red, green, blue and white sub-pixels in accordance with example embodiments.

The example embodiments are described more fully hereinafter with reference to the accompanying drawings. The inventive concept may, however, be embodied in many different forms and should not be construed as limited to the example embodiments set forth herein. In the drawings, the sizes and relative sizes of layers and regions may be exaggerated for clarity.

It will be understood that when an element or layer is referred to as being "on," "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like or similar reference numerals refer to like or similar elements throughout. As used herein, the term "and/or" includes any and all combinations of one or more of the associated listed items.

It will be understood that, although the terms first, second, third etc. may be used herein to describe various elements, components, regions, layers, patterns and/or sections, these elements, components, regions, layers, patterns and/or sections should not be limited by these terms. These terms are only used to distinguish one element, component, region, layer pattern or section from another region, layer, pattern or section. Thus, a first element, component, region, layer or section discussed below could be termed a second element, component, region, layer or section without departing from the teachings of example embodiments.

Spatially relative terms, such as "beneath," "below," "lower," "above," "upper" and the like, may be used herein for ease of description to describe one element or feature's relationship to another element(s) or feature(s) as illustrated In the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular example embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Example embodiments are described herein with reference to cross sectional illustrations that are schematic illustrations of illustratively idealized example embodiments (and intermediate structures) of the inventive concept. As such, variations from the shapes of the illustrations as a result, for example, of manufacturing techniques and/or tolerances, are to be expected. Thus, example embodiments should not be construed as limited to the particular shapes of regions illustrated herein but are to include deviations in shapes that result, for example, from manufacturing. The regions illustrated in the figures are schematic in nature and their shapes are not intended to illustrate the actual shape of a region of a device and are not intended to limit the scope of the inventive concept.

Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 2:
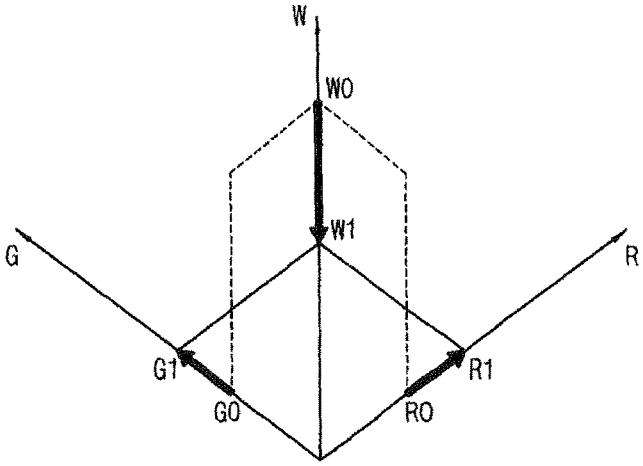
FIG. 2 is a diagram illustrating a color space of an organic light emitting display device in accordance with example embodiments.
Figure 3:
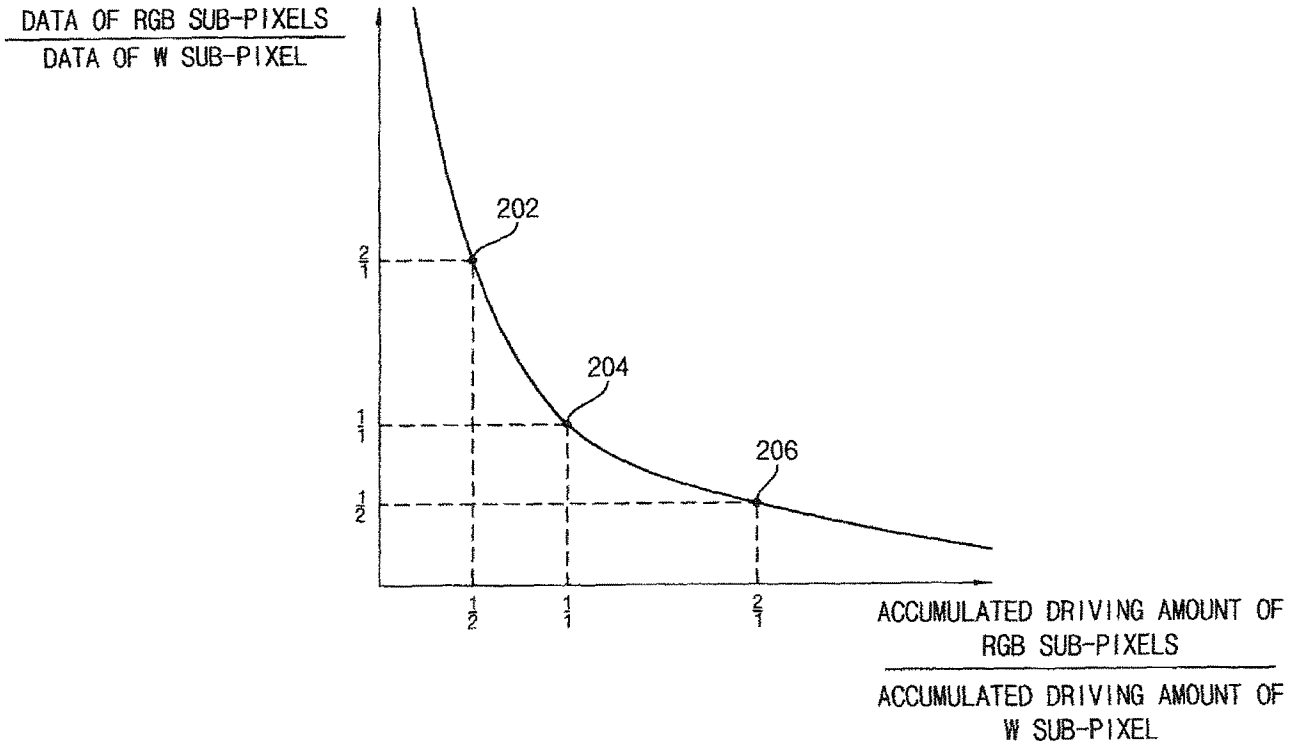
FIG. 3 is a diagram illustrating a data ratio for a white portion according to an accumulated driving amount ratio in accordance with example embodiments.
Figure 4:
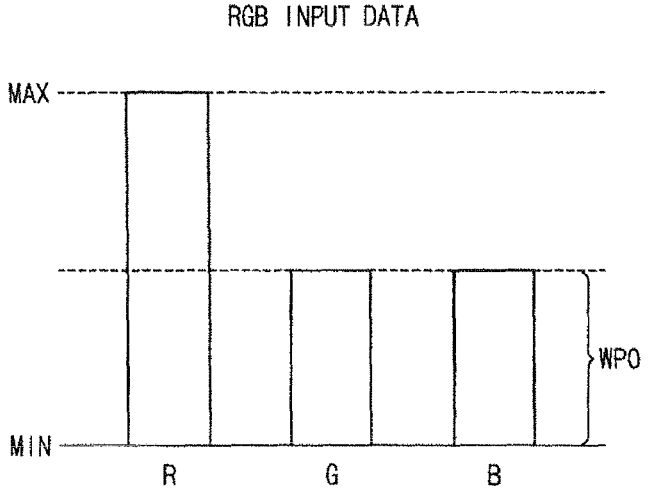
FIG. 4 is a diagram illustrating an example of RGB input data of an organic light emitting display device in accordance with example embodiments.
Figure 5A:
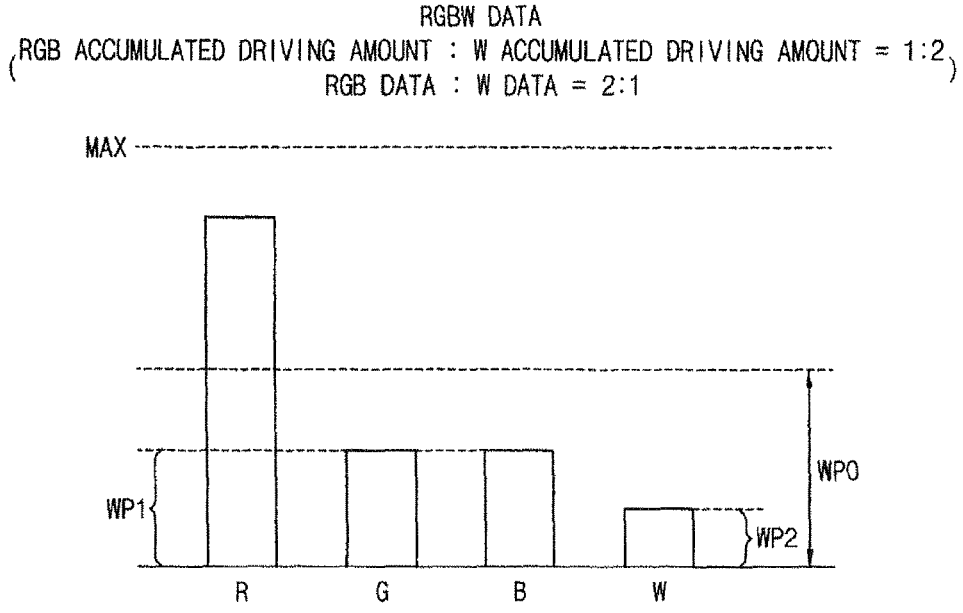
FIGS. 5A through 5C are diagrams illustrating examples of RGBW data in a method of operating an organic light emitting display device in accordance with example embodiments.
Figure 5B:
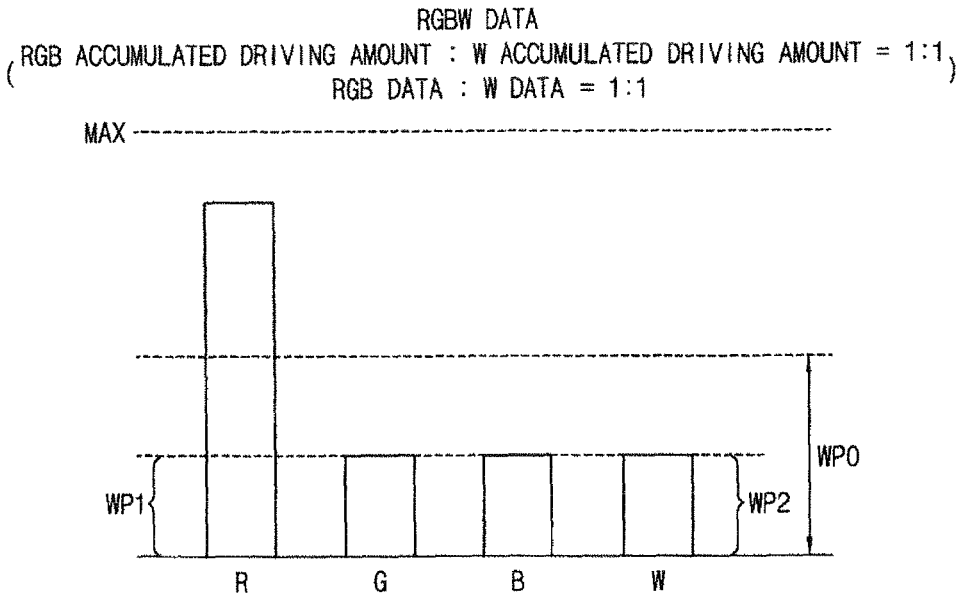
Figure 5C:
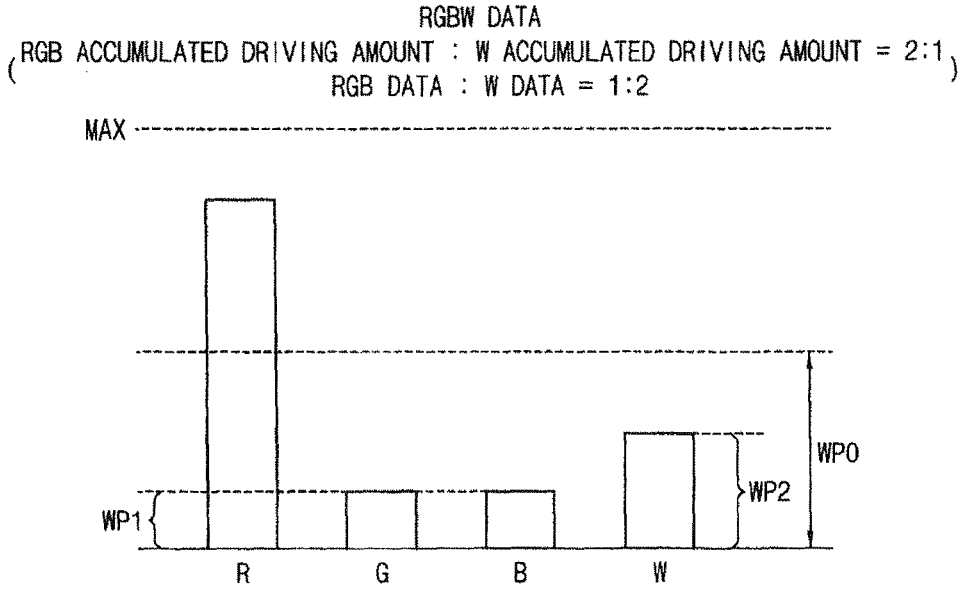

FIG. 1 is a flow chart illustrating a method of operating an organic light emitting display device including red, green, blue and white sub-pixels in accordance with example embodiments, FIG. 2 is a diagram illustrating a color space of an organic light emitting display device in accordance with example embodiments, FIG. 3 is a diagram illustrating a data ratio for a white portion according to an accumulated driving amount ratio in accordance with example embodiments, FIG. 4 is a diagram illustrating an example of RGB input data of an organic light emitting display device in accordance with example embodiments, and FIGS. 5A through 5C are diagrams illustrating examples of RGBW data in a method of operating an organic light emitting display device in accordance with example embodiments.

Referring to FIG. 1, in a method of operating an organic light emitting display device including a white (W) sub-pixel as well as red, green and blue (RGB) sub-pixels, a first gamma voltage for the RGB sub-pixels and a second gamma voltage for the W sub-pixel are adjusted such that a sum of maximum luminances of the RGB sub-pixels is substantially equal to a luminance of a white color displayed by the organic light emitting display device (S 110). Here, the maximum luminances of the RGB sub-pixels are luminances of the RGB sub-pixels when the RGB sub-pixels are in saturated color states. For example, the maximum luminances of the RGB sub-pixels may be luminances of lights emitted by the RGB sub-pixels using the maximum gray voltage. Here, the sum of the maximum luminances of the RGB sub-pixels is a vector sum that reflects not only scalar amounts of the maximum luminances but also colors of lights emitted by the RGB sub-pixels.

In the organic light emitting display device, the white color may be represented by the RGB sub-pixels as well as the W sub-pixel, and the luminance of the white color displayed by the organic light emitting display device may be a sum of a luminance of a white color represented by the RGB sub-pixels and a luminance of a white color represented by the W sub-pixel. In some example embodiments, to make the sum of the maximum luminances of the RGB sub-pixels substantially equal to the luminance of the white color displayed by the organic light emitting display device, the organic light emitting display device may satisfy following Equation 1.

$$Jrgb*Lrgb=k*Jrgb*Lrgb+(1-k)*Jw*Lw \quad \text{Equation 1}$$

Here, Lrgb is a sum of the maximum luminances of the RGB sub-pixels before the first gamma voltage is adjusted, Jrgb is a consumption current change ratio of the RGB sub-pixels, or a ratio of a consumption current of the RGB sub-pixels after the first gamma voltage is adjusted to a consumption current of the RGB sub-pixels before the first gamma voltage is adjusted, Lw is a maximum luminance of the W sub-pixel before the second gamma voltage is adjusted, and Jw is a consumption current change ratio of the W sub-pixel, or a ratio of a consumption current of the W sub-pixel after the second gamma voltage is adjusted to a consumption current of the W sub-pixel before the second gamma voltage is adjusted. Further, k is a ratio of the luminance of the white color represented by the RGB sub-pixels to the luminance of the white color displayed by the organic light emitting display device, and 1-k is a ratio of the luminance of the white color represented by the W sub-pixel to the luminance of the white color displayed by the organic light emitting display device. The k may have a value ranging from 0 to 1. For example, if k is 0.2, 20% of the white color displayed by the organic light emitting display device is represented by the RGB sub-pixels, and 80% of the white color displayed by the organic light emitting display device is represented by the W sub-pixel. Equation 1 may be simplified to following Equation 2.

$$Jrgb*Lrgb=Jw*Lw \quad \text{Equation 2}$$

In Equation 2, the left-hand side is the sum of the maximum luminances of the RGB sub-pixels after the first gamma voltage is adjusted, and the right-hand side is the maximum luminance of the W sub-pixel after the second gamma voltage is adjusted. Thus, in order to make the sum of the maximum luminances of the RGB sub-pixels substantially equal to the luminance of the white color displayed by the organic light emitting display device as in Equation 1 by adjusting the first and second gamma voltages, the organic light emitting display device may make the sum of the maximum luminances of the RGB sub-pixels substantially equal to the maximum luminance of the W sub-pixel as in Equation 2 by adjusting the first and second gamma voltages.

In some example embodiments, to satisfy Equation 2, the organic light emitting display device may increase the consumption current of the RGB sub-pixels by increasing the first gamma voltage for the RGB sub-pixels, thereby increasing the sum of the maximum luminances of the RGB sub-pixels. Further, to satisfy Equation 2, the organic light emitting display device may decrease the consumption current of the W sub-pixel by decreasing the second gamma voltage for the W sub-pixel, thereby decreasing the maximum luminance of the W sub-pixel.

For example, as illustrated in FIG. 2, if the first gamma voltage is increased the maximum luminance of a red color represented by the R sub-pixel may be increased from R0 to R1, and the maximum luminance of a green color represented by the G sub-pixel may be increased from G0 to G1. In a color space illustrated in FIG. 2, a blue color axis (not shown) may be perpendicular to a red color axis and a green color axis, and the maximum luminance of a blue color represented by the B sub-pixel may be also increased by increasing the first gamma voltage. Further, if the second gamma voltage is decreased, the maximum luminance of the white color represented by the W sub-pixel may be decreased from W0 to W1.

The organic light emitting display device may increase the first gamma voltage and may decrease the second gamma voltage such that a vector sum of the maximum luminance R1 of the R sub-pixel, the maximum luminance G1 of the G sub-pixel and the maximum luminance of the B sub-pixel (not shown) that are increased as the first gamma voltage is increased is substantially equal to the maximum luminance W1 of the W sub-pixel that is decreased as the second gamma voltage is decreased. That is, organic light emitting display device may satisfy Equation 2. An increment of the first gamma voltage and a decrement of the second gamma voltage may be determined as will be described below.

In some example embodiments, the organic light emitting display device may increase the first gamma voltage in inverse proportion to a ratio of an aperture size of the RGB sub-pixels to an aperture size of a pixel. For example, in a case where the respective RGBW sub-pixels have the same aperture size, the aperture size of the RGB sub-pixels to the aperture size of the pixel may be 3:4, or 3/4. In this case, the first gamma voltage for the RGB sub-pixels may be increased to 3/4 times, or about 1.33 times. If the first gamma voltage is increased to 3/4 times, the consumption current change ratio Jrgb of the RGB sub-pixels may become 4/3, and the sum of the maximum luminances of the RGB sub-pixels may be increased to 3/4 times. That is, the left-hand side of Equation 2, or the sum Jrgb*Lrgb of the maximum luminances of the RGB sub-pixels after the first gamma voltage is increased may be 4/3 times of the sum Lrgb of the maximum luminances of the RGB sub-pixels before the first gamma voltage is increased.

Further, the organic light emitting display device may decrease the second gamma voltage in inverse proportion to a ratio of the maximum luminance of the W sub-pixel to the sum of the maximum luminances of the RGB sub-pixels after the first gamma voltage is increased. A ratio of the maximum luminance of the white sub-pixel to the sum of the maximum luminances of the RGB sub-pixels before the first and second gamma voltages are adjusted may be measured by a test equipment. Generally, the maximum luminance of the white sub-pixel may be greater than the sum of the maximum luminances of the RGB sub-pixels. For example, in an RGBW type organic light emitting display device including a W sub-pixel having no color filter and RGB sub-pixels having RGB color filters, a ratio of the maximum luminance of the W sub-pixel to the sum of the maximum luminances of the RGB sub-pixels may be about 2:1, or about 2/1. In this case, a ratio of the maximum luminance of the W sub-pixel before the second gamma voltage is adjusted to the sum of maximum luminances of the RGB sub-pixels after the first gamma voltage is increased may be about 2:1.33, or about 2/1.33, and the organic light emitting display device may decrease the second gamma voltage in inverse proportion to the ratio of about 2/1.33. That is, the organic light emitting display device may decrease the second gamma voltage to 1.33/2 times. If the second gamma voltage is decreased to 1.33/2 times, the consumption current change ratio Jw of the W sub-pixel may become 1.33/2, and the maximum luminance of the W sub-pixel may be decreased to 1.33/2 times. Accordingly, since the left-hand side (Jrgb*Lrgb) of Equation 2 is "4/3*Lrgb", the right-hand side (Jw*Lw) of Equation 2 is "(4/3)/2*Lw", and Lw:Lrgb is 2:1, Equation 2 is satisfied.

As described above, if the first gamma voltage is increased in inverse proportion to the ratio of the aperture size of the RGB sub-pixels to the aperture size of the pixel, and the second gamma voltage is decreased in inverse proportion to the ratio of the maximum luminance of the white sub-pixel to the sum of the maximum luminances of the RGB sub-pixels after the first gamma voltage is increased, Equation 2 is satisfied, and the sum of the maximum luminances of the RGB sub-pixels may be substantially equal to the maximum luminance of the W sub-pixel. Further, if Equation 2 is satisfied, Equation 1 is satisfied, and the sum of maximum luminances of the RGB sub-pixels may be substantially equal to the luminance of the white color displayed by the organic light emitting display device. Accordingly, since luminances of respective pure colors represented by the RGB sub-pixels are increased, and the luminance of the white color represented by the W sub-pixel is decreased, the organic light emitting display device according to example embodiments may prevent a simultaneous contrast phenomenon that a pure color looks darker because of a bright white background.

Additionally, with respect to FIG. 1, the organic light emitting display device adjusts a ratio of first data of the RGB sub-pixels to second data of the W sub-pixel with respect to a white portion of input data based on a first accumulated driving amount of the RGB sub-pixels and a second accumulated driving amount of the W sub-pixel (S130). The first accumulated driving amount of the RGB sub-pixels may be calculated by accumulating a product of gray values of the RGB sub-pixels (or a mean gray value of the RGB sub-pixels), driving times of the RGB sub-pixels (or a mean driving time of the RGB sub-pixels) and a ratio of the first gamma voltage after being adjusted to the first gamma voltage before being adjusted, and the second accumulated driving amount of the W sub-pixel may be calculated by accumulating a product of a gray value of the W sub-pixel, a driving time of the W sub-pixel and a ratio of the second gamma voltage after being adjusted to the second gamma voltage before being adjusted.

In some example embodiments, the organic light emitting display device may calculate a ratio of the first accumulated driving amount of the RGB sub-pixels to the second accumulated driving amount of the W sub-pixel, and may determine the ratio of the first data of the RGB sub-pixels to the second data of the W sub-pixel with respect to the white portion of the input data in inverse proportion to the ratio of the first accumulated driving amount to the second accumulated driving amount. As described above, the organic light emitting display device may calculate the first accumulated driving amount by accumulating the product of the gray values of the RGB sub-pixels, the driving times of the RGB sub-pixels and the ratio of the first gamma voltage after being adjusted to the first gamma voltage before being adjusted, may calculate the second accumulated driving amount by accumulating the product of the gray value of the W sub-pixel, the driving time of the W sub-pixel and the ratio of the second gamma voltage after being adjusted to the second gamma voltage before being adjusted, and may calculate the ratio of the first accumulated driving amount to the second accumulated driving amount based on the calculated first and second accumulated driving amounts. Further, to determine the ratio of the first data to the second data, the organic light emitting display device may satisfy following Equation 3.

$$k*(Jrgb*Trgb)=(1-k)*(Jw*Tw) \quad \text{Equation 3}$$

Here, Trgb is an accumulated driving amount of the RGB sub-pixels based on the first gamma voltage before being adjusted, and is calculated by accumulating a product of the gray values of the RGB sub-pixels and the driving times of the RGB sub-pixels. Further, Tw is an accumulated driving amount of the W sub-pixel based on the second gamma voltage before being adjusted, and is calculated by accumulating a product of the product of the gray value of the W sub-pixel and the driving time of the W sub-pixel. Equation 3 may be simplified to following Equation 4.

$$k/(1-k)=1/((Jrgb*Trgb)/(Jw*Tw)) \quad \text{Equation 4}$$

In Equation 4, k/(1-k) is the ratio of the first data of the RGB sub-pixels to the second data of the W sub-pixel with respect to the white portion of the input data, and ((Jrgb*Trgb)/(Jw*Tw)) is the ratio of the first accumulated driving amount of the RGB sub-pixels to the second accumulated driving amount of the W sub-pixel.

Thus, as illustrated in FIG. 3, the ratio of the first data of the RGB sub-pixels to the second data of the W sub-pixel may be determined in inverse proportion to the ratio of the first accumulated driving amount of the RGB sub-pixels to the second accumulated driving amount of the W sub-pixel.

For example, as illustrated in FIG. 4, the organic light emitting display device may receive RGB input data having a white portion WP0. Here, the white portion WP0 may correspond to the minimum data among R data, G data and B data included in the RGB input data. In a case where the ratio of the first accumulated driving amount of the RGB sub-pixels to the second accumulated driving amount of the W sub-pixel is 1:2 (i.e., a point 202 in FIG. 3) as illustrated in FIG. 5A, the organic light emitting display device may determine the ratio of the first data WP1 of the RGB sub-pixels to the second data WP2 of the W sub-pixel with respect to the white portion W0 of the RGB input data as a reciprocal number of the ratio of the first accumulated driving amount of the RGB sub-pixels to the second accumulated driving amount, or as 2:1. Accordingly, the organic light emitting display device may convert the RGB input data into RGBW data including R data, G data and B data that are decreased by one third of the white portion WP0 from the RGB input data, and further including W data WP2 corresponding to one third of the white portion WP0. The organic light emitting display device may drive the RGB sub-pixels and the W sub-pixel based on the RGBW data, and a ratio of a luminance of a white color represented by the RGB sub-pixels to a luminance of a white color represented by the W sub-pixel may be 2:1.

In a case where the ratio of the first accumulated driving amount of the RGB sub-pixels to the second accumulated driving amount of the W sub-pixel is 1:1 (i.e., a point 204 in FIG. 3) as illustrated in FIG. 5B, the organic light emitting display device may determine the ratio of the first data WP1 of the RGB sub-pixels to the second data WP2 of the W sub-pixel with respect to the white portion W0 of the RGB input data as a reciprocal number of the ratio of the first accumulated driving amount to the second accumulated driving amount, or as 1:1. Accordingly, the organic light emitting display device may convert the RGB input data into RGBW data including R data, G data and B data that are decreased by a half of the white portion WP0 from the RGB input data, and further including W data WP2 corresponding to a half of the white portion WP0. The organic light emitting display device may drive the RGB sub-pixels and the W sub-pixel based on the RGBW data, and a ratio of a luminance of a white color represented by the RGB sub-pixels to a luminance of a white color represented by the W sub-pixel may be 1:1.

In a case where the ratio of the first accumulated driving amount of the RGB sub-pixels to the second accumulated driving amount of the W sub-pixel is 2:1 (i.e., a point 206 in FIG. 3) as illustrated in FIG. 5C, the organic light emitting display device may determine the ratio of the first data WP 1 of the RGB sub-pixels to the second data WP2 of the W sub-pixel with respect to the white portion W0 of the RGB input data as a reciprocal number of the ratio of the first accumulated driving amount to the second accumulated driving amount, or as 1:2. Accordingly, the organic light emitting display device may convert the RGB input data into RGBW data including R data, G data and B data that are decreased by two thirds of the white portion WP0 from the RGB input data, and further including W data WP2 corresponding to two thirds of the white portion WP0. The organic light emitting display device may drive the RGB sub-pixels and the W sub-pixel based on the RGBW data, and a ratio of a luminance of a white color represented by the RGB sub-pixels to a luminance of a white color represented by the W sub-pixel may be 1:2.

As described above, since the ratio of the first data WP1 of the RGB sub-pixels to the second data WP2 of the W sub-pixel is determined in inverse proportion to the ratio of the first accumulated driving amount of the RGB sub-pixels to the second accumulated driving amount of the W sub-pixel, a difference between the first accumulated driving amount of the RGB sub-pixels and the second accumulated driving amount of the W sub-pixel may be reduced. Accordingly, luminance degradation of the W sub-pixel may be similar to luminance degradation of the RGB sub-pixels. Thus, in the organic light emitting display device according to example embodiments, a lifetime of the W sub-pixel may be similar to a lifetime of each RGB sub-pixel, which results in the optimization of lifetimes of the sub-pixels.

In some example embodiments, the organic light emitting display device may store the first and second accumulated driving amounts in a nonvolatile memory device during a termination operation, and may read the first and second accumulated driving amounts from the first and second accumulated driving amounts during a subsequent initialization operation. For example, the first and second accumulated driving amounts may be stored in the nonvolatile memory device when the organic light emitting display device is powered off or enters a sleep mode, and the first and second accumulated driving amounts may be read from the nonvolatile memory device when the organic light emitting display device is powered on or enters a normal operation mode.

For example, the organic light emitting display device may read a first previous accumulated driving amount of the RGB sub-pixels and a second previous accumulated driving amount of the W sub-pixel from the nonvolatile memory device, may calculate the first accumulated driving amount by accumulating, in addition to the first previous accumulated driving amount, the product of the gray values of the RGB sub-pixels, the driving times of the RGB sub-pixels and the ratio of the first gamma voltage after being adjusted to the first gamma voltage before being adjusted, and may calculate the second accumulated driving amount by accumulating, in addition to the second previous accumulated driving amount, the product of the gray value of the W sub-pixel, the driving time of the W sub-pixel and the ratio of the second gamma voltage after being adjusted to the second gamma voltage before being adjusted. The organic light emitting display device may determine the ratio of the first data to the second data with respect to the white portion by calculating the ratio of the calculated first accumulated driving amount to the calculated second accumulated driving amount. In some example embodiments, the nonvolatile memory device may be implemented inside the organic light emitting display device or inside a host device. For example, during an initialization operation of the organic light emitting display device, the organic light emitting display device may receive the first and second previous accumulated driving amounts stored in the nonvolatile memory device from the host device. During a termination operation of the organic light emitting display device, the organic light emitting display device may transmit the calculated first and second accumulated driving amounts to the host device to store the calculated first and second accumulated driving amounts in the nonvolatile memory device. The transmitted first and second accumulated driving amounts may be used as the first and second previous accumulated driving amounts during a subsequent initialization operation.

In some example embodiments, the ratio of the first data to the second data with respect to the white portion of the input data may be periodically adjusted. For example, the organic light emitting display device may count a number of frames of the input data, and may compare the counted number of frame with reference frame number. When the counted number of frames is equal to the reference frame number, the organic light emitting display device may adjust the ratio of the first data to the second data with respect to the white portion of the input data.

As described above, in the method of operating the organic light emitting display device according to example embodiments, a simultaneous contrast may be prevented since the sum of the maximum luminances of the RGB sub-pixels is substantially equal to the maximum luminance of the W sub-pixel, and the lifetime of the RGBW sub-pixels may be optimized since the ratio of the first data of the RGB sub-pixels to the second data of the W sub-pixel is determined in inverse proportion to the ratio of the first accumulated driving amount of the RGB sub-pixels to the second accumulated driving amount of the W sub-pixel.

Figure 6:
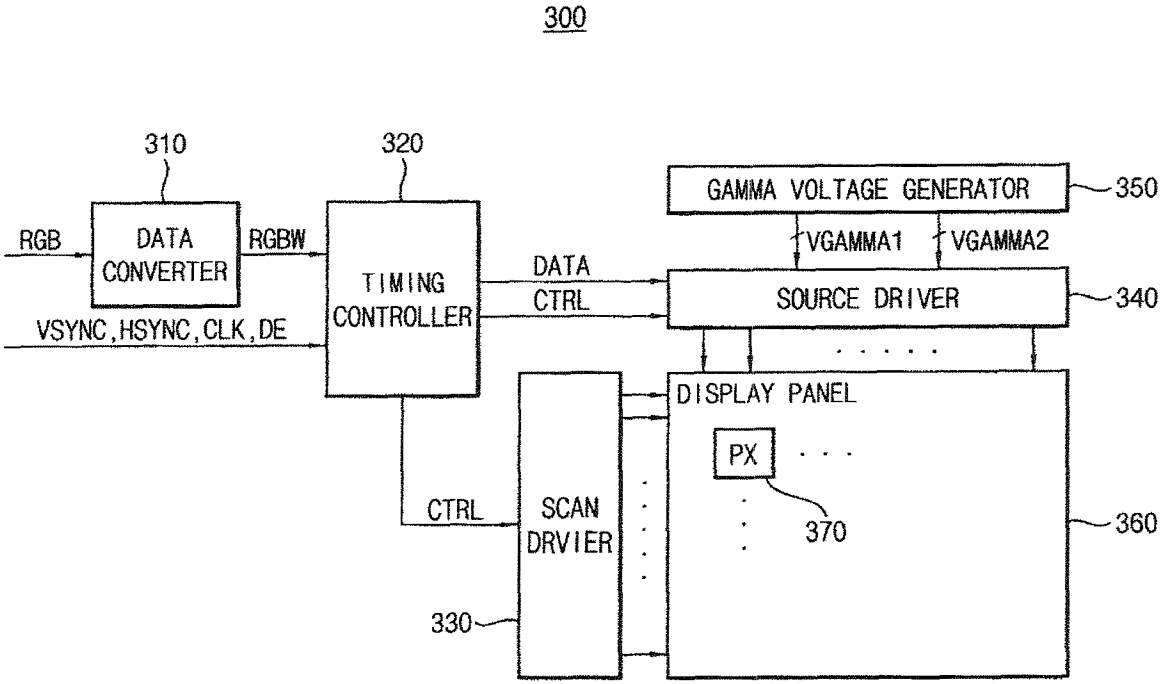
FIG. 6 is a block diagram illustrating an organic light emitting display device including red, green, blue and white sub-pixels in accordance with example embodiments.
Figure 7A:
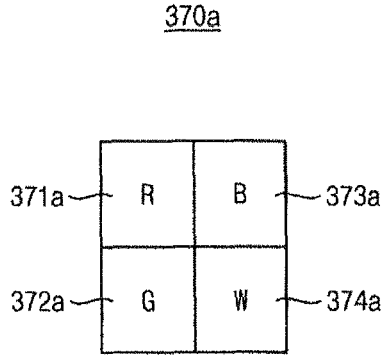
FIGS. 7A and 7B are diagrams illustrating examples of a pixel included in an organic light emitting display device of FIG. 6.
Figure 7B:
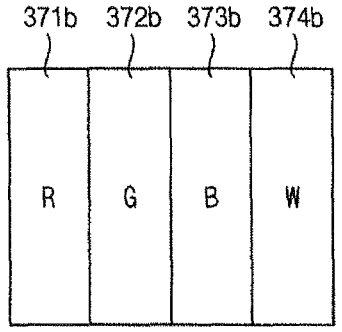
Figure 8:
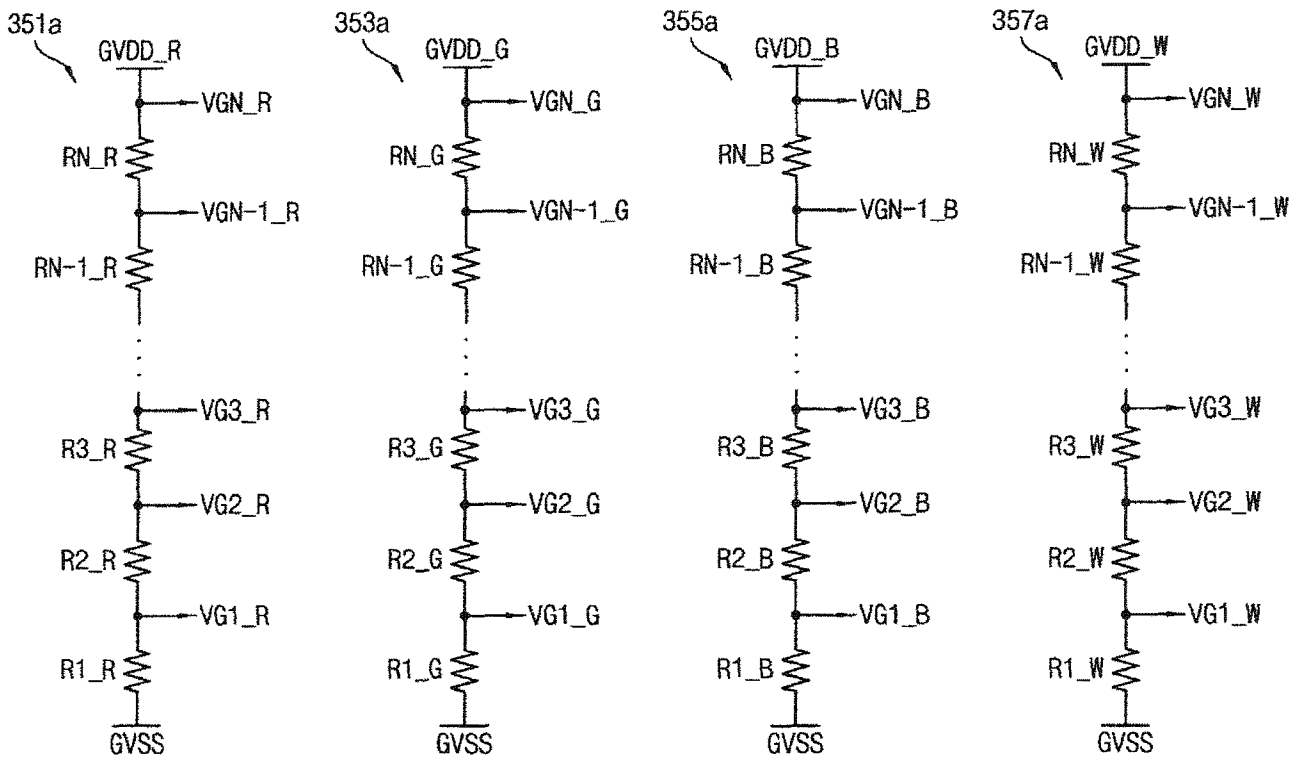
FIG. 8 is a diagram illustrating an example of a gamma voltage generator included in an organic light emitting display device of FIG. 6.
Figure 9:
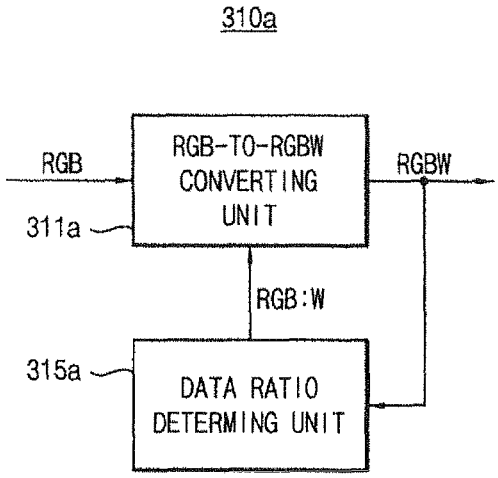
FIG. 9 is a diagram illustrating an example of a data converter included in an organic light emitting display device of FIG. 6.
Figure 10:
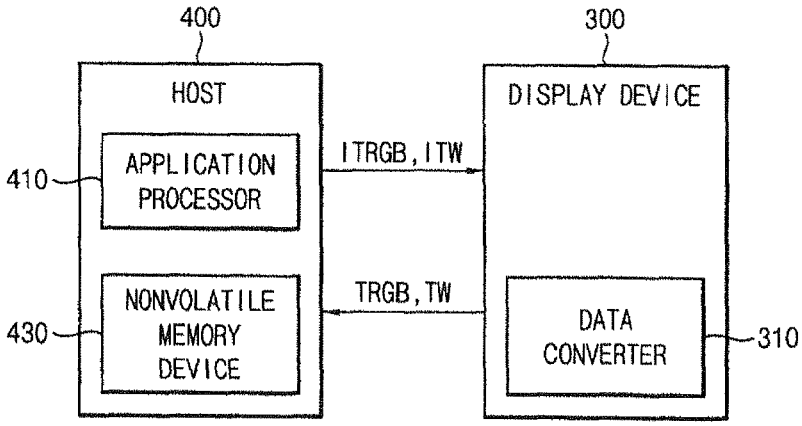
FIG. 10 is a block diagram illustrating an organic light emitting display device and a host device in accordance with example embodiments.

FIG. 6 is a block diagram illustrating an organic light emitting display device including red, green, blue and white sub-pixels in accordance with example embodiments, FIGS. 7A and 7B are diagrams illustrating examples of a pixel included in an organic light emitting display device of FIG. 6, FIG. 8 is a diagram illustrating an example of a gamma voltage generator included in an organic light emitting display device of FIG. 6, FIG. 9 is a diagram illustrating an example of a data converter included in an organic light emitting display device of FIG. 6, and FIG. 10 is a block diagram illustrating an organic light emitting display device and a host device in accordance with example embodiments.

Referring to FIG. 6, an organic light emitting display device 300 includes a data converter 310, a timing controller 320, a scan driver 330, a source (data) driver 340, a gamma voltage generator 350 and a display panel 360.

The display panel 360 may include a plurality of pixels 370 that are arranged in a matrix having a plurality of rows and a plurality of columns. Each pixel 370 may include an R sub-pixel, a G sub-pixel, a B sub-pixel and a W sub-pixel. In some example embodiments, as illustrated in FIG. 7A, each pixel 370*a* may include an R sub-pixel 371*a*, a G sub-pixel 372*a*, a B sub-pixel 373*a* and a W sub-pixel 374*a* that are arranged in a matrix having two rows and two columns. In other example embodiments, as illustrated in FIG. 7B, each pixel 370*b* may include an R sub-pixel 371*b*, a G sub-pixel 372*b*, a B sub-pixel 373*b* and a W sub-pixel 374*b* that are arranged in one row. Further, in some example embodiments, the R sub-pixel 371*a* and 371*b* may include a white OLED and a red filter, the G sub-pixel 372*a* and 372*b* may include a white OLED and a green filter, the B sub-pixel 373*a* and 373*b* may include a white OLED and a blue filter, and the W sub-pixel 374*a* and 374*b* may include a white OLED without a color filter. In other example embodiments, all sub-pixels 371*a*, 371*b*, 372*a*, 372*b*, 373*a*, 373*b*, 374*a* and 374*b* may not include color filters, the R sub-pixel 371*a* and 371*b* may include a red OLED emitting red light, the G sub-pixel 372*a* and 372*b* may include a green OLED emitting green light, the B sub-pixel 373*a* and 373*b* may include a blue OLED emitting blue light, and the W sub-pixel 374*a* and 374*b* may include a white OLED emitting white light.

The data converter 310 may receive RGB input data, and may convert the RGB input data into RGBW data including R data, G data, B data and W data.

The timing controller 320 may receive the RGBW data from the data converter 310, and may receive control signals VSYNC, HSYNC, CLK and DE from a host device. For example, the control signals VSYNC, HSYNC, CLK and DE may include a vertical synchronization signal VSYNC, a horizontal synchronization signal HSYNC, a clock signal CLK and a data enable signal DE. The timing controller 320 may generate image data DATA provided to the source driver 340 and a control signal CTRL provided to the scan driver 330 and the source driver 340 based on the RGBW data and the control signals VSYNC, HSYNC, CLK and DE. The timing controller 320 may provide the source driver 340 with the RGBW data received from the data converter 310 as the image data DATA.

The scan driver 330 and the source driver 340 may be controlled by the timing controller 320 to drive the display panel 360. For example, the scan driver 330 may turn on or off thin film transistors (TFTs) formed on the display panel 360. The source driver 340 may select a gamma voltage VGAMMA1 and VGAMMA2 generated by the gamma voltage generator 350 based on the image data DATA provided from the timing controller 320, and may apply, as a data voltage, the selected gamma voltage VGAMMA1 and VGAMMA2 to the display panel 360.

The gamma voltage generator 350 may generate a first gamma voltage VGAMMA1 for the RGB sub-pixels and a second gamma voltage VGAMMA2 for the W sub-pixel. In some example embodiments, the first gamma voltage VGAMMA1 may be commonly used for the RGB sub-pixels. In other example embodiments, the first gamma voltage VGAMMA1 may include a plurality of gamma voltages respectively used for the R sub-pixel, the G sub-pixel and the B sub-pixel. The gamma voltage generator 350 may generate the first and second gamma voltages VGAMMA1 and VGAMMA2 that are adjusted such that a sum of maximum luminances of the RGB sub-pixels is substantially equal to a luminance of a white color displayed by the display panel 360. In some example embodiments, the gamma voltage generator 350 may generate the first and second gamma voltages VGAMMA1 and VGAMMA2 that are adjusted such that the sum of the maximum luminances of the RGB sub-pixels is substantially equal to a maximum luminance of the W sub-pixel.

For example, as illustrated in FIG. 8, the gamma voltage generator 350*a* may include a first voltage divider 351*a* that generates gamma voltages VG1_R, VG2_R, VG3_R, . . . , VGN-1_R and VGN_R for the R sub-pixel, a second voltage divider 353*a* that generates gamma voltages VG1_G, VG2_G, VG3_G, . . . , VGN-1_G and VGN_G for the G sub-pixel, a third voltage divider 355*a* that generates gamma voltages VG1_B, VG2_B, VG3_B, . . . , VGN-1B and VGN_B for the B sub-pixel, and a fourth voltage divider 357*a* that generates gamma voltages VG1_W, VG2_W, VG3_, . . . , VGN-1_W and VGN_W for the W sub-pixel. In this case, the first gamma voltage VGAMMA1 for the RGB sub-pixels may include the gamma voltages VG1_R, VG2_R, VG3_R, . . . , VGN-1_R and VGN_R generated by the first voltage divider 351*a*, the gamma voltages VG1_G, VG2_G, VG3_G, . . . , VGN-1_G and VGN_G generated by the second voltage divider 353*a* and the gamma voltages VG1_B, VG2_B, VG3_B, . . . , VGN-1_B and VGN_B generated by the third voltage divider 355*a*. Further, the second gamma voltage VGAMMA2 for the W sub-pixel may include the gamma voltages VG1_W, VG2_W, VG3_W, . . . , VGN-1_W and VGN_W generated by the fourth voltage divider 357*a*.

The first voltage divider 351*a* may include a plurality of resistors R1_R, R2_R, R3_R, . . . , RN-1_R and RN_R that are connected in series between a red gamma power supply voltage GVDD_R and a gamma ground voltage GVSS, and may generate the gamma voltages VG1_R, VG2_R, VG3_R, . . . , VGN-1_R and VGN_R for the R sub-pixel by dividing the red gamma power supply voltage GVDD_R. The second voltage divider 353*a* may include a plurality of resistors R1_G, R2_G, R3_G, . . . , RN-1_G and RN_G that are connected in series between a green gamma power supply voltage GVDD_G and the gamma ground voltage GVSS, and may generate the gamma voltages VG1_G, VG2_G, VG3_G, . . . , VGN-1_G and VGN_G for the G sub-pixel by dividing the green gamma power supply voltage GVDD_G. The third voltage divider 355*a* may include a plurality of resistors R1_B, R2_B, R3_B, . . . , RN-1_B and RN_B that are connected in series between a blue gamma power supply voltage GVDD_B and the gamma ground voltage GVSS, and may generate the gamma voltages VG1_B, VG2_B, VG3_B, . . . , VGN-1_B and VGN_B for the B sub-pixel by dividing the blue gamma power supply voltage GVDD_B. The fourth voltage divider 357*a* may include a plurality of resistors R1_W, R2_W, R3_W, . . . , RN-1_W and RN_W that are connected in series between a white gamma power supply voltage GVDD_W and the gamma ground voltage GVSS, and may generate the gamma voltages VG1_W, VG2_W, VG3_W, . . . , VGN-1_W and VGN_W for the W sub-pixel by dividing the white gamma power supply voltage GVDD_W.

The gamma voltage generator 350*a* may adjust the first gamma voltage VGAMMA1 and the second gamma voltage VGAMMA2 by adjusting the red gamma power supply voltage GVDD_R, the green gamma power supply voltage GVDD_G, the blue gamma power supply voltage GVDD_B and the white gamma power supply voltage GVDD_W. For example, the red gamma power supply voltage GVDD_R, the green gamma power supply voltage GVDD_G and the blue gamma power supply voltage GVDD_B may be increased to increase the first gamma voltage VGAMMA1, which results in the increase of the sum of the maximum luminances of the RGB sub-pixels. Further, the white gamma power supply voltage GVDD_W may be decreased to decrease the second gamma voltage VGAMMA2, which results in the decrease of the maximum luminance of the W sub-pixel.

In some example embodiments, to increase the first gamma voltage VGAMMA1 for the RGB sub-pixels, the red, green and blue gamma power supply voltages GVDD_R, GVDD_G and GVDD_B may be increased in inverse proportion to a ratio of an aperture size of the RGB sub-pixels to an aperture size of a pixel. For example, in a case where the respective RGBW sub-pixels have the same aperture size, the first gamma voltage VGAMMA1 may be increased to 4/3 times by increasing each of the red, green and blue power supply voltages GVDD_R, GVDD_G and GVDD_B to 4/3 times. If each of the red, green and blue gamma power supply voltages GVDD_R, GVDD_G and GVDD_B are increased to 4/3 times, each of the gamma voltages VG1_R, VGN_R, VG3_R, . . . , VGN-1_R, VGN_R, VG1_G, VG2_G, VG3_G, . . . , VGN-1_G, VGN_G, VG1_B, VG2_B, VG3_B, . . . , VGN-1_B and VGN_B for the RGB sub-pixels may be increased to 4/3 times.

Further, to decrease the second gamma voltage VGAMMA2 for the W sub-pixel, the white gamma power supply voltage GVDD_W may be decreased in inverse proportion to a ratio of the maximum luminance of the W sub-pixel to the sum of the maximum luminances of the RGB sub-pixels after the first gamma voltage VGAMMA1 is increased. For example, in a case where a ratio of the maximum luminance of the W sub-pixel to the sum of the maximum luminances of the RGB sub-pixels before the first gamma voltage VGAMMA1 is increased is 2:1, and the first gamma voltage VGAMMA1 is increased to 4/3 times, the second gamma voltage VGAMMA2 may be decreased to 2/3 times by decreasing the white gamma power supply voltage GVDD_W to 2/3 times. If the white gamma power supply voltage GVDD_W is decreased to 2/3 times, each of the gamma voltages VG1_W, VG2_W, VG3_W, . . . , VGN-1_W and VGN_W for the W sub-pixel may be decreased to 2/3 times.

In some example embodiments, the increase of the first gamma voltage VGAMMA1 and the decrease of the second gamma voltage VGAMMA2 may be performed when the organic light emitting display device 300 is manufactured. In other example embodiments, the increase to of the first gamma voltage VGAMMA1 and the decrease of the second gamma voltage VGAMMA2 may be performed during an initialization operation of the organic light emitting display device 300. In still other example embodiments, the increase of the first gamma voltage VGAMMA1 and the decrease of the second gamma voltage VGAMMA2 may be performed while the organic light emitting display device 300 operates.

As described above, since the gamma voltage generator 350 generates the increased first gamma voltage VGAMMA1 and the decreased second gamma voltage VGAMMA2, the sum of the maximum luminances of the RGB sub-pixels may be substantially equal to the maximum luminance of the W sub-pixel, and thus a simultaneous contrast may be prevented.

The data converter 310 may adjust a ratio of first data of the RGB sub-pixels to second data of the W sub-pixel with respect to a white portion of the RGB input data based on a first accumulated driving amount of the RGB sub-pixels and a second accumulated driving amount of the W sub-pixel, and may convert the RGB input data into the RGBW data based on the adjusted ratio of the first data to the second data.

For example, as illustrated in FIG. 9, the data converter 310*a* may include an RGB-to-RGBW converting unit 311*a* and a data ratio determining unit 315*a*. The data ratio determining unit 315*a* may determine the ratio RGB:W of the first data to the second data with respect to the white portion in inverse proportion to a ratio of the first accumulated driving amount to the second accumulated driving amount. For example, the data ratio determining unit 315*a* may calculate the first accumulated driving amount by accumulating a product of gray values of the RGB sub-pixels, driving times of the RGB sub-pixels and a ratio of the first gamma voltage VGAMMA1 after being increased to the first gamma voltage VGAMMA1 before being increased based on the RGBW data output from the RGB-to-RGBW converting unit 311*a*, may calculate the second accumulated driving amount by accumulating a product of a gray value of the W sub-pixel, a driving time of the W sub-pixel and a ratio of the second gamma voltage VGAMMA2 after being decreased to the second gamma voltage VGAMMA2 before being decreased, and may calculate the ratio RGB:W of the first data to the second data in inverse proportion to the ratio of the calculated first accumulated driving amount to the calculated second accumulated driving amount. The RGB-to-RGBW converting unit 311*a* may convert the RGB input data into the RGBW data based on the ratio RGB:W of the first data to the second data with respect to the white portion.

As described above, since the RGB data is converted into the RGBW data based on the ratio of the first data to the second data that is determined in inverse proportion to the ratio of the first accumulated driving amount to the second accumulated driving amount, luminance degradation of the W sub-pixel may be similar to luminance degradation of the RGB sub-pixels, and thus lifetimes of the sub-pixels may be optimized.

In some example embodiments, as illustrated in FIG. 10, the data converter 310 included in the organic light emitting display device 300 may receive a first previous accumulated driving amount ITRGB of the RGB sub-pixels and a second previous accumulated driving amount ITW of the W sub-pixel stored in a nonvolatile memory device 430 from a host device 400 during an initialization operation of the organic light emitting display device 300 (e.g., when the organic light emitting display device 300 is powered on or when the organic light emitting display device 300 enters a normal operation mode). For example, an application processor 410 included in the host device 400 may read the first previous accumulated driving amount ITRGB and the second previous accumulated driving amount ITW from the nonvolatile memory device 430, and may provide the read first and second previous accumulated driving amounts ITRGB and ITW to the organic light emitting display device 300.

While the organic light emitting display device 300 operates, the data converter 310 may calculate a first accumulated driving amount TRGB by accumulating, in addition to the first previous accumulated driving amount ITRGB, the product of the gray values of the RGB sub-pixels, the driving times of the RGB sub-pixels and the ratio of the first gamma voltage VGAMMA1 after being increased to the first gamma voltage VGAMMA1 before being increased, and may calculate a second accumulated driving amount TW by accumulating, in addition to the second previous accumulated driving amount ITW, the product of the gray value of the W sub-pixel, the driving time of the W sub-pixel and the ratio of the second gamma voltage VGAMMA2 after being decreased to the second gamma voltage VGAMMA2 before being decreased.

During a termination operation of the organic light emitting display device 300 (e.g., when the organic light emitting display device 300 is powered off or when the organic light emitting display device 300 enters a sleep mode), the data converter 310 may provide the first and second accumulated driving amounts TRGB and TW to store the first and second accumulated driving amounts TRGB and TW in the nonvolatile memory device 430. For example, the application processor 410 of the host device 400 may receive the first and second accumulated driving amounts TRGB and TW from the organic light emitting display device 300, and may store the received first and second accumulated driving amounts TRGB and TW in the nonvolatile memory device 430. The first and second accumulated driving amounts TRGB and TW stored in the nonvolatile memory device 430 may be used as the first and second previous accumulated driving amounts ITRGB and ITW during a subsequent initialization operation.

According to example embodiments, the nonvolatile memory device 430 may be implemented with an erasable programmable read-only memory (EPROM), an electrically erasable programmable read-only memory (EEPROM), a flash memory, a phase change random access memory (PRAM), a resistance random access memory (RRAM), a nano floating gate memory (NFGM), a polymer random access memory (PoRAM), a magnetic random access memory (MRAM), a ferroelectric random access memory (FRAM), etc.

The source driver 340 may receive the increased first gamma voltage VGAMMA1 and the decreased second gamma voltage VGAMMA2 from the gamma voltage generator 350, and may receive the RGB data RGBW as the image data DATA from the data converter 310 via the timing controller 320. The source driver 340 may drive the RGBW sub-pixels based on the increased first gamma voltage VGAMMA1, the decreased second gamma voltage VGAMMA2 and the RGBW data. In the organic light emitting display device 300 according to example embodiments, since the first and second gamma voltages VGAMMA1 and VGAMMA2 are adjusted such that the sum of the maximum luminances of the RGB sub-pixels is substantially equal to the maximum luminance of the W sub-pixel, and the RGBW data are converted from the RGB data based on the ratio of the first accumulated driving amount of the RGB sub-pixels to the second accumulated driving amount of the W sub-pixel, the simultaneous contrast may be prevented and lifetimes of the sub-pixels may be optimized.

Figure 11:
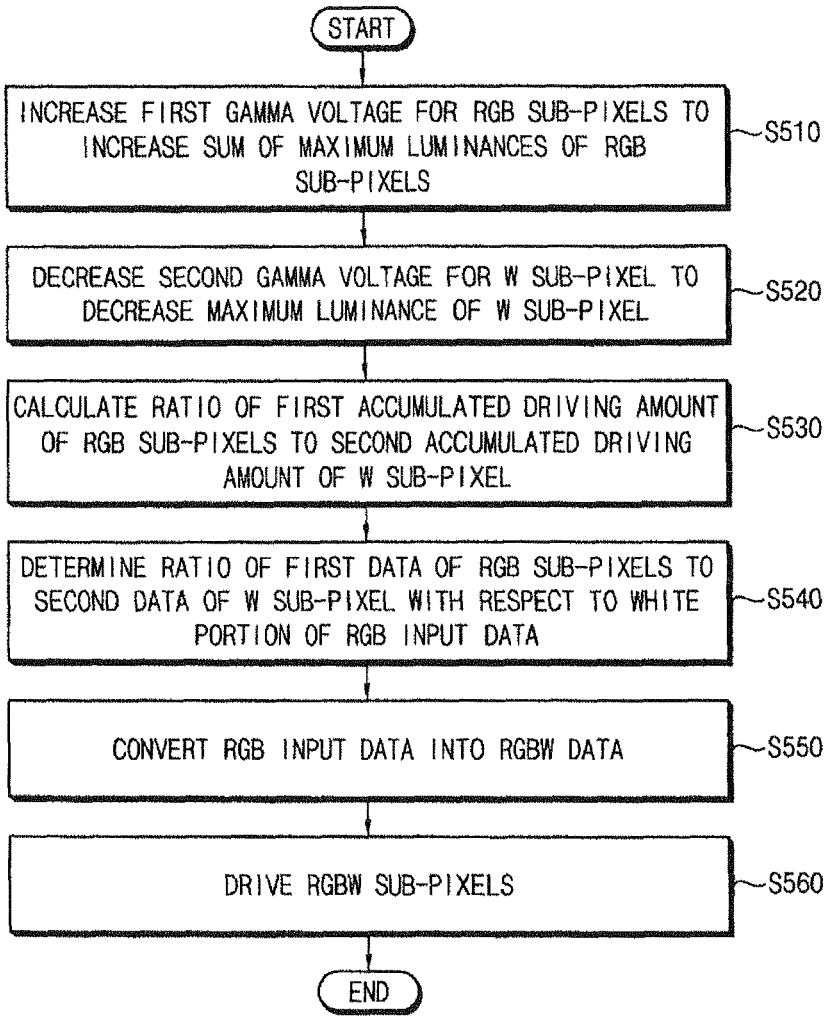
FIG. 11 is a flow chart illustrating a method of operating an organic light emitting display device including red, green, blue and white sub-pixels in accordance with example embodiments.

FIG. 11 is a flow chart illustrating a method of operating an organic light emitting display device including red, green, blue and white sub-pixels in accordance with example embodiments;

Referring to FIG. 11, in an organic light emitting display device including RGBW sub-pixels, a first gamma voltage for RGB sub-pixels is increased to increase a sum of luminances of the RGB sub-pixels (S510). For example, the first gamma voltage may be increased in inverse proportion to a ratio of an aperture size of the RGB sub-pixels to an aperture size of a pixel.

A second gamma voltage for a W sub-pixel is decreased to decrease a maximum luminance of the W sub-pixel (S520). For example, the second gamma voltage may be decreased in inverse proportion to a ratio of the maximum luminance of the W sub-pixel to the sum of the maximum luminances of the RGB sub-pixels after the first gamma voltage is increased.

A ratio of a first accumulated driving amount of the RGB sub-pixels to a second accumulated driving amount of the W sub-pixel is calculated (S530). For example, the first accumulated driving amount may be calculated by accumulating a product of gray values of the RGB sub-pixels, driving times of the RGB sub-pixels and a ratio of the first gamma voltage after being increased to the first gamma voltage before being increased, the second accumulated driving amount may be calculated by accumulating a product of a gray value of the W sub-pixel, a driving time of the W sub-pixel and a ratio of the second gamma voltage after being decreased to the second gamma voltage before being decreased, and the ratio of the calculated first accumulated driving amount to the calculated second accumulated driving amount may be calculated. In some example embodiments, a first previous accumulated driving amount of the RGB sub-pixels and a second previous accumulated driving amount of the W sub-pixel may be read from a nonvolatile memory device, the first and second accumulated driving amounts may be calculated based on the first and second previous accumulated driving amounts.

A ratio of first data of the RGB sub-pixels to second data of the W sub-pixel with respect to a white portion of RGB input data is determined in inverse proportion to the ratio of the first accumulated driving amount to the second accumulated driving amount (S540). In some example embodiments, the ratio of the first data to the second data with respect to the white portion may be determined periodically or per a predetermined number of frames. For example, a number of frames of the RGB input data may be counted, and the counted number of frames may be compared with a reference frame number. When the counted number of frames is equal to the reference frame number, the ratio of the first data to the second data with respect to the white portion of the RGB input data may be adjusted.

The RGB input data is converted into RGBW data based on the ratio of the first data to the second data with respect to the white portion (S550), and the RGBW sub-pixels are driven based on the increased first gamma voltage, the decreased second gamma voltage and the RGBW data (S560).

As described above, in the method of operating the organic light emitting display device according to example embodiments, the simultaneous contrast may be prevented since the sum of the maximum luminances of the RGB sub-pixels is substantially equal to the maximum luminance of the W sub-pixel. Further, in the method of operating the organic light emitting display device according to example embodiments, since the ratio of the first data of the RGB sub-pixels to the second data to the W sub-pixel with respect to the white portion is determined in inverse proportion to the ratio of the first accumulated driving amount of the RGB sub-pixels to the second accumulated driving amount of the W sub-pixel, lifetimes of the RGBW sub-pixels may be optimized, and a lifetime of the organic light emitting display device may be extended.

Figure 12:
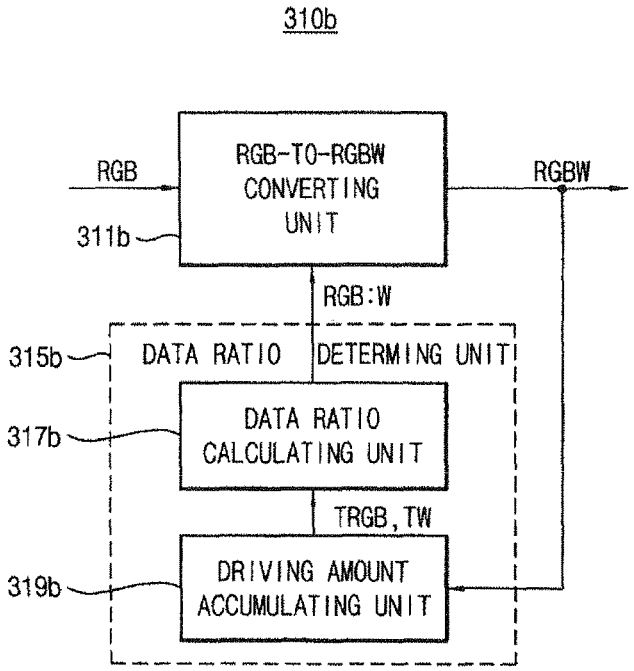
FIG. 12 is a diagram illustrating an example of a data converter in accordance with example embodiments.

FIG. 12 is a diagram illustrating an example of a data converter in accordance with example embodiments.

Referring to FIG. 12, a data converter 310*b* includes an RGB-to-RGBW converting unit 311*b* and a data ratio determining unit 315*b*.

The data ratio determining unit 315*b* may determine a ratio RGB:W of first data of RGB sub-pixels to second data of a W sub-pixel with respect to a white portion of RGB input data in inverse proportion to a ratio of a first accumulated driving amount TRGB of the RGB sub-pixels to a second accumulated driving amount TW of the W sub-pixel. For example, the data ratio determining unit 315*b* may include a data ratio calculating unit 317*b* and a driving amount accumulating unit 319*b*.

The driving amount accumulating unit 319*b* may receive RGBW data from the RGB-to-RGBW converting unit 311*b*. The driving amount accumulating unit 319*b* may calculate the first accumulated driving amount TRGB by accumulating a product of gray values of the RGB sub-pixels, driving times of the RGB sub-pixels and a ratio of a first gamma voltage after being adjusted to the first gamma voltage before being adjusted based on the RGBW data, and may calculate the second accumulated driving amount TW by accumulating a product of a gray value of the W sub-pixel, a driving time of the W sub-pixel and a ratio of a second gamma voltage after being adjusted to the second gamma voltage before being adjusted. In other example embodiments, the driving amount accumulating unit 319*b* may calculate the first accumulated driving amount TRGB by accumulating a product of the gray values of the RGB sub-pixels and the driving times of the RGB sub-pixels, and may calculate the second accumulated driving amount TW by accumulating a product of the gray value of the W sub-pixel and the driving time of the W sub-pixel. In this case, the data ratio calculating unit 317*b* may apply the first gamma voltage change ratio and the second gamma voltage change ratio to the first and second accumulated driving amounts TRGB and TW.

The data ratio calculating unit 317*b* may receive the first accumulated driving amount TRGB and the second accumulated driving amount TW from the driving amount accumulating unit 319*b*, and may calculate the ratio RGB:W of the first data to the second data with respect to the white portion in inverse proportion to the ratio of the first accumulated driving amount TRGB to the second accumulated driving amount TW.

The RGB-to-RGBW converting unit 311*b* may convert the RGB input data into the RGBW data based on the ratio RGB:W of the first data to the second data with respect to the white portion.

As described above, the data converter 310*b* may determine the ratio RGB:W of the first data to the second data with respect to the white portion in inverse proportion to the ratio of the first accumulated driving amount TRGB to the second accumulated driving amount TW, and may convert the RGB input data into the RGBW data based on the ratio RGB:W of the first data to the second data with respect to the white portion. Accordingly, luminance degradation of the W sub-pixel may be similar to luminance degradation of the RGB sub-pixels, and a lifetime of the W sub-pixel may be similar to a lifetime of each RGB sub-pixel.

Figure 13A:
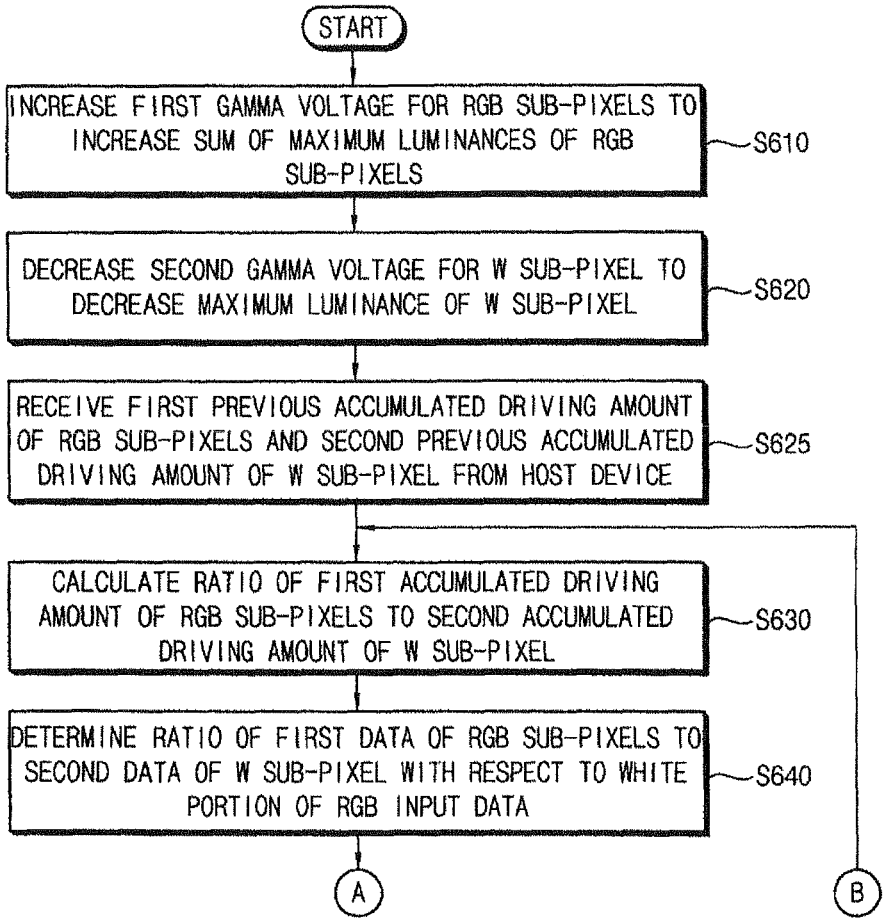
FIGS. 13A and 13B are a flow chart illustrating a method of operating an organic light emitting display device including red, green, blue and white sub-pixels in accordance with example embodiments.
Figure 13B:
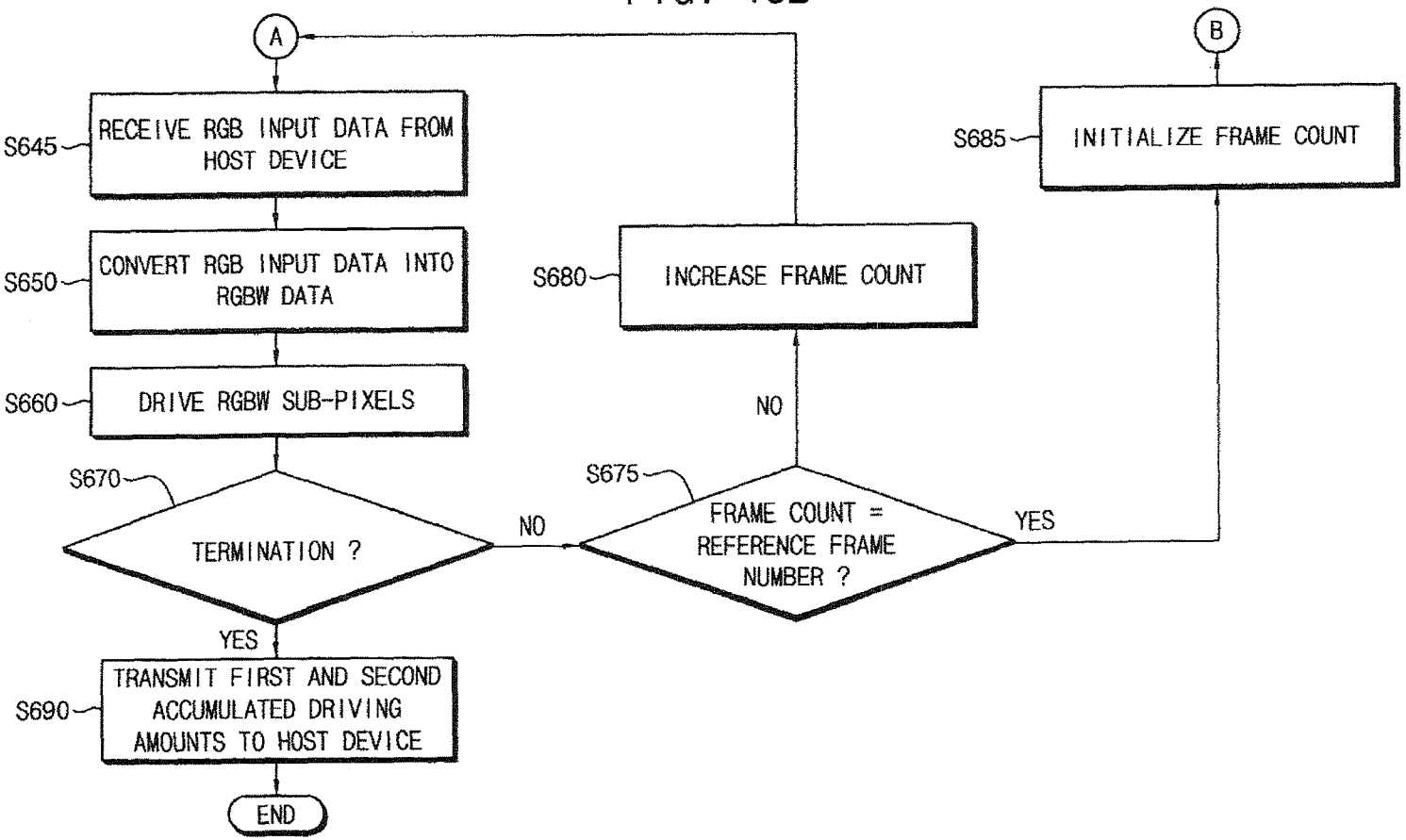

FIGS. 13A and 13B are a flow chart illustrating a method of operating an organic light emitting display device including red, green, blue and white sub-pixels in accordance with example embodiments.

Referring to FIGS. 13A and 13B, in an organic light emitting display device including RGBW sub-pixels, a first gamma voltage for RGB sub-pixels is increased to increase a sum of luminances of the RGB sub-pixels (S610). A second gamma voltage for a W sub-pixel is decreased to decrease a maximum luminance of the W sub-pixel (S620). In some example embodiments, the increase of the first gamma voltage and the decrease of the second gamma voltage may be performed when the organic light emitting display device is manufactured.

During an initialization operation of the organic light emitting display device, the organic light emitting display device may receive a first previous accumulated driving amount of the RGB sub-pixels and a second previous accumulated driving amount of the W sub-pixel from a nonvolatile memory device included in a host device (S625).

A ratio of a first accumulated driving amount of the RGB sub-pixels to a second accumulated driving amount of the W sub-pixel is calculated (S630). For example, the first accumulated driving amount may be calculated by accumulating, in addition to the first previous accumulated driving amount, a product of gray values of the RGB sub-pixels, driving times of the RGB sub-pixels and a ratio of the first gamma voltage after being increased to the first gamma voltage before being increased, the second accumulated driving amount may be calculated by accumulating, in addition to the second previous accumulated driving amount, a product of a gray value of the W sub-pixel, a driving time of the W sub-pixel and a ratio of the second gamma voltage after being decreased to the second gamma voltage before being decreased, and the ratio of the calculated first accumulated driving amount to the calculated second accumulated driving amount may be calculated.

A ratio of first data of the RGB sub-pixels to second data of the W sub-pixel with respect to a white portion of RGB input data is determined in inverse proportion to the ratio of the first accumulated driving amount to the second accumulated driving amount (S640).

The organic light emitting display device may receive the RGB input data from the host device (S645), and may convert the RGB input data into RGBW data based on the ratio of the first data to the second data with respect to the white portion (S650). The organic light emitting display device may drive the RGBW sub-pixels based on the increased first gamma voltage, the decreased second gamma voltage and the RGBW data (S660).

The organic light emitting display device may count a number of frames of the RGB input data. If the counted number of frames is different from a predetermined reference frame number (S675: NO), the organic light emitting display device may increase the counted number of frames by 1 (S680), and may receive the next frame of the RGB input data (S645). If the counted number of frames is the same as a predetermined reference frame number (S675: YES), the organic light emitting display device may initialize the counted number of frames to 0 (S685), and may determine again the ratio of the first data to the second data with respect to the white portion in inverse proportion to the ratio of the first accumulated driving amount to the second accumulated driving amount (S630 and S640).

During a termination operation of the organic light emitting display device (S670: YES), the organic light emitting display device may transmit the first and second accumulated driving amounts to the host device (S690), and the host device may store the first and second accumulated driving amounts in the nonvolatile memory device. The first and second accumulated driving amounts stored in the nonvolatile memory device may be used as the first and second previous the nonvolatile memory device during a subsequent initialization operation.

As described above, in the method of operating the organic light emitting display device according to example embodiments, the simultaneous contrast may be prevented since the sum of the maximum luminances of the RGB sub-pixels is substantially equal to the maximum luminance of the W sub-pixel. Further, in the method of operating the organic light emitting display device according to example embodiments, since the ratio of the first data of the RGB sub-pixels to the second data to the W sub-pixel with respect to the white portion is determined in inverse proportion to the ratio of the first accumulated driving amount of the RGB sub-pixels to the second accumulated driving amount of the W sub-pixel, lifetimes of the RGBW sub-pixels may be optimized, and a lifetime of the organic light emitting display device may be extended.

Figure 14:
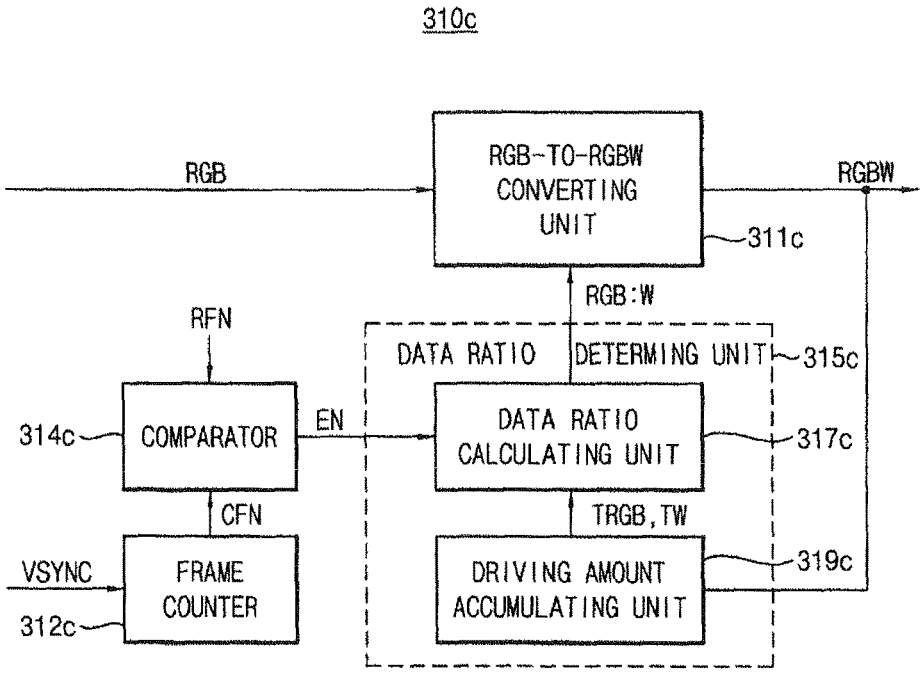
FIG. 14 is a diagram illustrating an example of a data converter in accordance with example embodiments.

FIG. 14 is a diagram illustrating an example of a data converter in accordance with example embodiments.

Referring to FIG. 14, a data converter 310*c* includes an RGB-to-RGBW converting unit 311*c*, a data ratio determining unit 315*c*, a frame counter 312*c* and a comparator 314*c*.

The data ratio determining unit 315*c* may determine a ratio RGB:W of first data of RGB sub-pixels to second data of a W sub-pixel with respect to a white portion of RGB input data in inverse proportion to a ratio of a first accumulated driving amount TRGB of the RGB sub-pixels to a second accumulated driving amount TW of the W sub-pixel. For example, the data ratio determining unit 315*c* may include a driving amount accumulating unit 319*c* that calculates the first accumulated driving amount TRGB and the second accumulated driving amount TW based on RGBW data, and a data ratio calculating unit 317*c* that calculates the ratio RGB:W of the first data to the second data with respect to the white portion based on the first and second accumulated driving amounts TRGB and TW.

The frame counter 312*c* may count a number CFN of frames of the RGB input data. For example, the frame counter 312*c* may receive a vertical synchronization signal VSYNC from a host device, and may count the number CFN of frames in response to the vertical synchronization signal VSYNC.

The comparator 314*c* may receive the counted number CFN of frames from the frame counter 312*c*, and may receive a reference frame number RFN from an external device (e.g., the host device or a timing controller). The reference frame number RFN may be changed according to example embodiments. For example, the reference frame number RFN may correspond to several tens of minutes or several hours in time. The comparator 314*c* may compare the counted number CFN of frames with the reference frame number RFN, and may generate an enable signal EN for activating the data ratio determining unit 315*c* when the counted number CFN of frames is the same as the reference frame number RFN. For example, the driving amount accumulating unit 319*c* may accumulate the first and second accumulated driving amounts TRGB and TW at each frame, and the data ratio calculating unit 317*c* may calculate the ratio RGB:W of the first data to the second data with respect to the white portion when the enable signal EN is generated.

The RGB-to-RGBW converting unit 311*c* may convert the RGB input data into the RGBW data based on the ratio RGB:W of the first data to the second data with respect to the white portion.

As described above, the data converter 310*c* may determine the ratio RGB:W of the first data to the second data with respect to the white portion in inverse proportion to the ratio of the first accumulated driving amount TRGB to the second accumulated driving amount TW, and may convert the RGB input data into the RGBW data based on the ratio RGB:W of the first data to the second data with respect to the white portion. Accordingly, luminance degradation of the W sub-pixel may be similar to luminance degradation of the RGB sub-pixels, and a lifetime of the W sub-pixel may be similar to a lifetime of each RGB sub-pixel.

Figure 15:
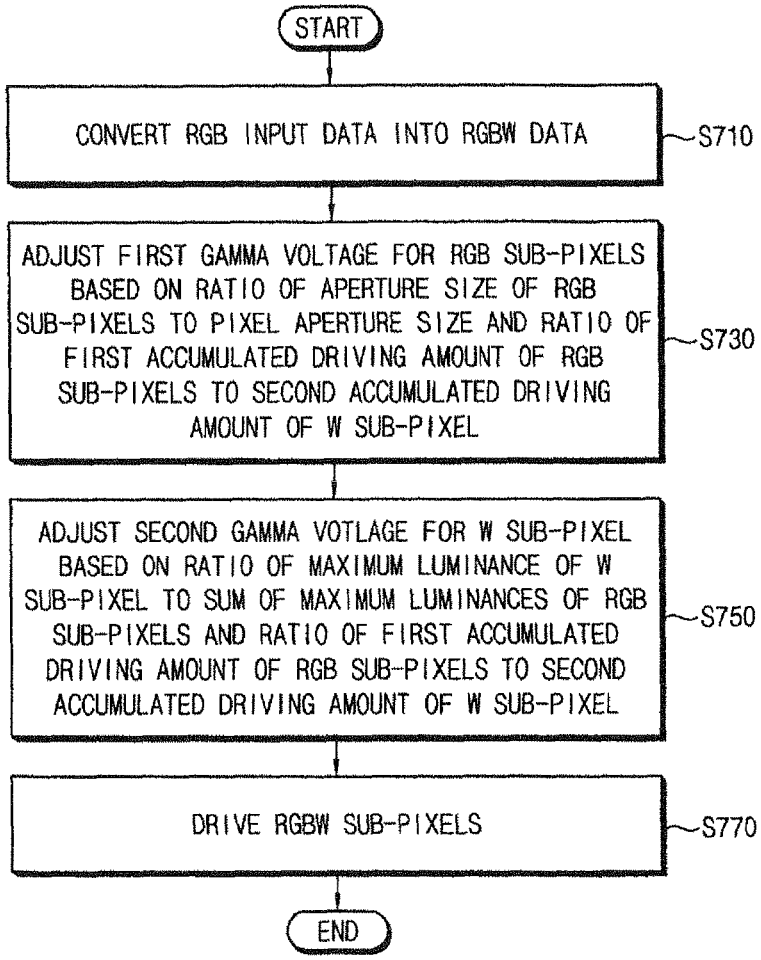
FIG. 15 is a flow chart illustrating a method of operating an organic light emitting display device including red, green, blue and white sub-pixels in accordance with example embodiments.

FIG. 15 is a flow chart illustrating a method of operating an organic light emitting display device including red, green, blue and white sub-pixels in accordance with example embodiments.

Referring to FIG. 15, an organic light emitting display device including RGBW sub-pixels converts RGB input data received from a host device into RGBW data (S710). In some example embodiments, a ratio of first data of RGB sub-pixels to second data of a W sub-pixel with respect to a white portion may be fixed.

The organic light emitting display device may adjust a first gamma voltage for the RGB sub-pixels and a second gamma voltage for the W sub-pixel based on a ratio of an aperture size of the RGB sub-pixels to an aperture size of a pixel, a ratio of a maximum luminance of the W sub-pixel to a sum of maximum luminances of the RGB sub-pixels, and a ratio of a first accumulated driving amount of the RGB sub-pixels to a second accumulated driving amount of the W sub-pixel (S730, S750). For example, the organic light emitting display device may adjust the first gamma voltage in inverse proportion to the ratio of the aperture size of the RGB sub-pixels to the aperture size of the pixel and in inverse proportion to the ratio of the first accumulated driving amount to the second accumulated driving amount (S730). Further, the organic light emitting display device may adjust the second gamma voltage in inverse proportion to the ratio of the maximum luminance of the W sub-pixel to the sum of the maximum luminances of the RGB sub-pixels and in proportion to the ratio of the first accumulated driving amount to the second accumulated driving amount (S750).

The organic light emitting display device may drive the RGBW sub-pixels based on the adjusted first gamma voltage, the adjusted second gamma voltage and the RGBW data (S770).

As described above, in the method of operating the organic light emitting display device according to example embodiments, while the organic light emitting display device operates, the first and second gamma voltages are adjusted to adjust luminances of the RGB sub-pixels and the W sub-pixel and driving amounts of the RGB sub-pixels and the W sub-pixel. Accordingly, in the method of operating the organic light emitting display device according to example embodiments, the simultaneous contrast may be prevented and lifetimes of the sub-pixels may be optimized.

Figure 16:
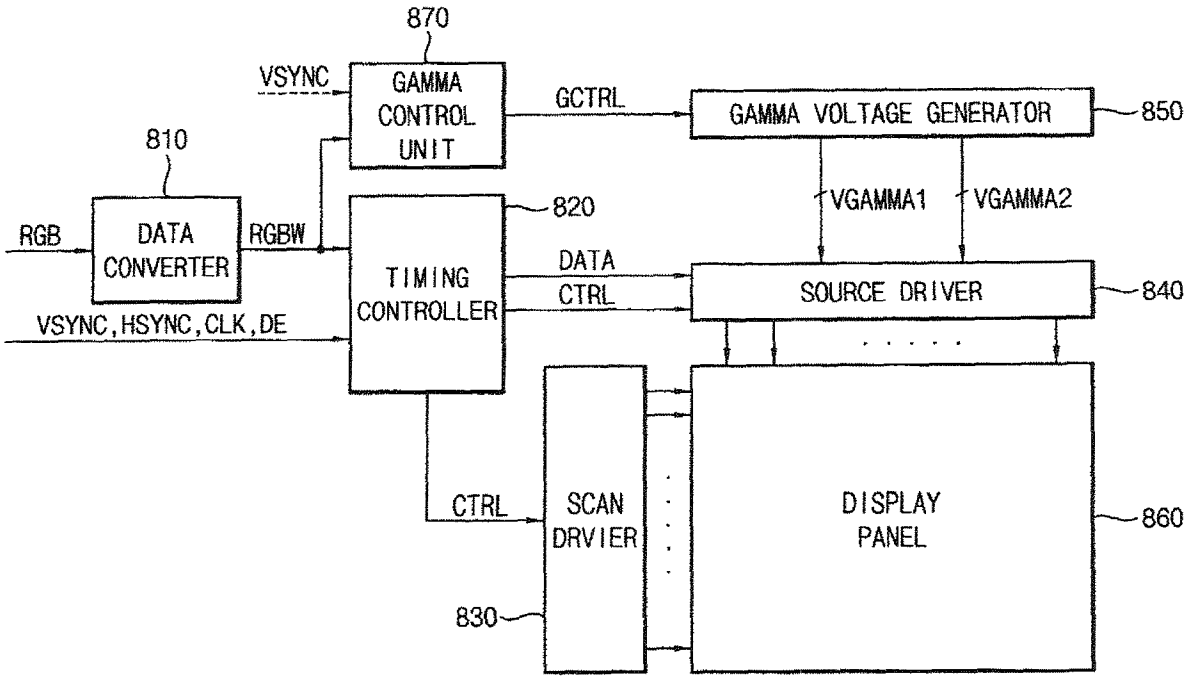
FIG. 16 is a block diagram illustrating an organic light emitting display device including red, green, blue and white sub-pixels in accordance with example embodiments.

FIG. 16 is a block diagram illustrating an organic light emitting display device including red, green, blue and white sub-pixels in accordance with example embodiments.

Referring to FIG. 16, an organic light emitting display device 800 includes a data converter 810, a timing controller 820, a scan driver 830, a source (data) driver 840, a gamma voltage generator 850, a display panel 860 and a gamma control unit 870. Compared with an organic light emitting display device 300 of FIG. 6, the organic light emitting display device 800 of FIG. 16 may further include the gamma control unit 870.

The gamma control unit 870 may generate a gamma control signal GCTRL for controlling the gamma voltage generator 850 to adjust a first gamma voltage VGAMMA1 for RGB sub-pixels and a second gamma voltage VGAMMA2 for a W sub-pixel while the organic light emitting display device 800 operates. In some example embodiments, the gamma control unit 870 may control the gamma voltage generator 850 to increase the first gamma voltage VGAMMA1 in inverse proportion to a ratio of an aperture size of the RGB sub-pixels to an aperture size of a pixel and to decrease the second gamma voltage VGAMMA2 in inverse proportion to a ratio of a maximum luminance of the W sub-pixel to a sum of maximum luminances of the RGB sub-pixels after the first gamma voltage VGAMMA1 is increased. In response the control signal GCTRL, the gamma voltage generator 850 may increase RGB gamma power supply voltages, and may decrease a W gamma power supply voltage. The gamma voltage generator 850 may generate the first and second gamma voltages VGAMMA1 and VGAMMA2 based on the increased RGB gamma power supply voltages and the decreased W gamma power supply voltage.

In other example embodiments, the gamma control unit 870 may control the gamma voltage generator 850 to adjust the first gamma voltage VGAMMA1 in inverse proportion to the ratio of the aperture size of the RGB sub-pixels to the aperture size of the pixel and in inverse proportion to a ratio of a first accumulated driving amount of the RGB sub-pixels to a second accumulated driving amount of the W sub-pixel. Further, the gamma control unit 870 may control the gamma voltage generator 850 to adjust the second gamma voltage VGAMMA2 in inverse proportion to the ratio of the maximum luminance of the W sub-pixel to the sum of the maximum luminances of the RGB sub-pixels and in proportion to the ratio of the first accumulated driving amount to the second accumulated driving amount. In this case, the data converter 810 may convert RGB input data into RGBW data with a fixed ratio, and the gamma control unit 870 may calculate the ratio of the first accumulated driving amount to the second accumulated driving amount based on the RGBW data.

In some example embodiments, the gamma control unit 870 may include a frame counter to count a number of frames of the RGB input data in response to a vertical synchronization signal VSYNC. The gamma control unit 870 control the gamma voltage generator 850 to adjust the first and second gamma voltages VGAMMA1 and VGAMMA2 when the counted number of frames is the same as a predetermined reference frame number.

As described above, the organic light emitting display device 800 may adjust the first and second gamma voltages VGAMMA1 and VGAMMA2, thereby preventing the simultaneous contrast and optimizing lifetimes of the sub-pixels.

Figure 17:
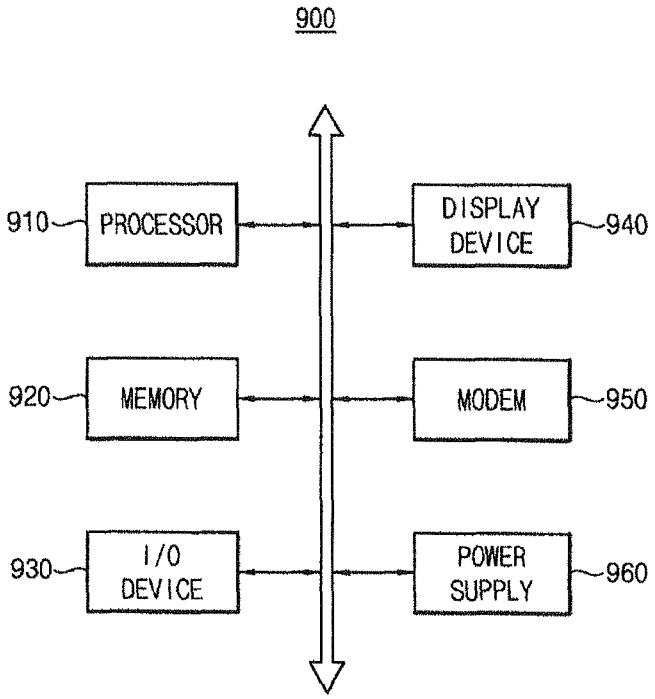
FIG. 17 is a block diagram illustrating a computing system including an organic light emitting display device in accordance with example embodiments.

FIG. 17 is a block diagram illustrating a computing system including an organic light emitting display device in accordance with example embodiments.

Referring to FIG. 17, a computing system 900 includes a processor 910 and an organic light emitting display device 940. In some example embodiments, the computing system 900 may further include a memory device 920, an input/output device 930, a modem 950 and a power supply 960.

The processor 910 may perform specific calculations or tasks. For example, the processor 910 may be a mobile system-on-chip (SOC), an application processor, a media processor, a microprocessor, a central process unit (CPU), a digital signal processor, or the like. The processor 910 may be coupled to the memory device 920 via an address bus, a control bus and/or a data bus. For example, the memory device 920 may be implemented by a dynamic random access memory (DRAM), a mobile DRAM, a static random access memory (SRAM), a phase change random access memory (PRAM), a resistance random access memory (RRAM), a nano floating gate memory (NFGM), a polymer random access memory (PoRAM), a magnetic random access memory (MRAM), a ferroelectric random access memory (FRAM), etc. Further, the processor 910 may be coupled to an extension bus, such as a peripheral component interconnect (PCI) bus. The processor 910 may control the input/output device 930 including an input device, such as a keyboard, a mouse, a keypad, etc., and an output device, such as a printer, a speaker, etc. via the extension bus. The processor 910 may be further coupled to the organic light emitting display device 940. In the organic light emitting display device 940, a sum of maximum luminances of RGB sub-pixels may be the same as a luminance of a white color displayed by the organic light emitting display device 940, and thus a simultaneous contrast may be prevented. Further, the organic light emitting display device 940 may adjust a ratio of first data of the RGB sub-pixels to second data of a W sub-pixel with respect to white portion based on a first accumulated driving amount of the RGB sub-pixels and a second accumulated driving amount of the W sub-pixel, thereby optimizing lifetimes of the sub-pixels.

Further, the processor 910 may control a storage device, such as a solid state drive, a hard disk drive, a CD-ROM, etc. via the extension bus. The modem 950 may perform wired or wireless communications with an external device. The power supply 960 may supply power to the computing system 900. In some example embodiments, the computing system 900 may further include an application chipset, a camera image processor (CIS), etc.

According to example embodiments, the computing system 900 may be any computing system including the organic light emitting display device 940, such as a digital television (TV), a 3D TV, a personal computer (PC), a home appliance, a laptop computer, a tablet computer, a mobile phone, a smart phone, a personal digital assistant (PDA), a portable multimedia player (PMP), a digital camera, a music player, a portable game console, a navigation device, etc.

The foregoing is illustrative of example embodiments, and is not to be construed as limiting thereof. Although a few example embodiments have been described, those skilled in the art will readily appreciate that many modifications are possible in the example embodiments without materially departing from the novel teachings and advantages of example embodiments. Accordingly, all such modifications are intended to be included within the scope of example embodiments as defined in the claims. In the claims, means-plus-function clauses are intended to cover the structures described herein as performing the recited function and not only structural equivalents but also equivalent structures. Therefore, it is to be understood that the foregoing is illustrative of example embodiments and is not to be construed as limited to the specific embodiments disclosed, and that modifications to the disclosed example embodiments, as well as other example embodiments, are intended to be included within the scope of the appended claims. The inventive concept is defined by the following claims, with equivalents of the claims to be included therein.

What is claimed is:

1. A method of operating an organic light emitting display device including a red sub-pixel, a green sub-pixel, a blue sub-pixel and a white sub-pixel, the method comprising:

adjusting a first gamma voltage for the red, green and blue sub-pixels and a second gamma voltage for the white pixel such that a sum of maximum luminances of the red, green and blue sub-pixels is substantially equal to a luminance of a white color displayed by the organic light emitting display device; and adjusting, with respect to a white portion of input data, a ratio of first data of the red, green and blue sub-pixels to second data of the white sub-pixel based on a first accumulated driving amount of the red, green and blue sub-pixels and a second accumulated driving amount of the white sub-pixel.

2. The method of claim 1, wherein adjusting the first gamma voltage and the second gamma voltage comprises:

adjusting the first gamma voltage and the second gamma voltage such that the sum of the maximum luminances of the red, green and blue sub-pixels is substantially equal to a maximum luminance of the white sub-pixel.

3. The method of claim 1, wherein adjusting the first gamma voltage and the second gamma voltage comprises:

increasing the first gamma voltage to increase the sum of the maximum luminances of the red, green and blue sub-pixels; and decreasing the second gamma voltage to decrease the maximum luminance of the white sub-pixel.

4. The method of claim 3, wherein increasing the first gamma voltage comprises:

increasing the first gamma voltage in inverse proportion to a ratio of an aperture size of the red, green and blue sub-pixels to an aperture size of a pixel.

5. The method of claim 3, wherein decreasing the second gamma voltage comprises:

decreasing the second gamma voltage in inverse proportion to a ratio of the maximum luminance of the white sub-pixel to the increased sum of the maximum luminances of the red, green and blue sub-pixels.

6. The method of claim 1, wherein adjusting the ratio of the first data to the second data with respect to the white portion of the input data comprises:

calculating a ratio of the first accumulated driving amount of the red, green and blue sub-pixels to the second accumulated driving amount of the white sub-pixel; and determining the ratio of the first data of the red, green and blue sub-pixels to the second data of the white sub-pixel with respect to the white portion of the input data in inverse proportion to the ratio of the first accumulated driving amount to the second accumulated driving amount.

7. The method of claim 6, wherein calculating the ratio of the first accumulated driving amount to the second accumulated driving amount comprises:

calculating the first accumulated driving amount by accumulating a product of gray values of the red, green and blue sub-pixels, driving times of the red, green and blue sub-pixels and a ratio of the first gamma voltage after being adjusted to the first gamma voltage before being adjusted;

calculating the second accumulated driving amount by accumulating a product of a gray value of the white sub-pixel, a driving time of the white sub-pixel and a ratio of the second gamma voltage after being adjusted to the second gamma voltage before being adjusted; and calculating the ratio of the calculated first accumulated driving amount to the calculated second accumulated driving amount.

8. The method of claim 6, wherein calculating the ratio of the first accumulated driving amount to the second accumulated driving amount comprises:

reading a first previous accumulated driving amount of the red, green and blue sub-pixels and a second previous accumulated driving amount of the white sub-pixel from a nonvolatile memory device;

calculating the first accumulated driving amount by accumulating, in addition to the first previous accumulated driving amount, a product of gray values of the red, green and blue sub-pixels, driving times of the red, green and blue sub-pixels and a ratio of the first gamma voltage after being adjusted to the first gamma voltage before being adjusted;

calculating the second accumulated driving amount by accumulating, in addition to the second previous accumulated driving amount, a product of a gray value of the white sub-pixel, a driving time of the white sub-pixel and a ratio of the second gamma voltage after being adjusted to the second gamma voltage before being adjusted; and calculating the ratio of the calculated first accumulated driving amount to the calculated second accumulated driving amount.

9. The method of claim 8, wherein the nonvolatile memory device is located at a host device.

10. The method of claim 9, further comprising:

receiving, from the host device, the first previous accumulated driving amount and the second previous accumulated driving amount stored in the nonvolatile memory device during an initialization operation of the organic light emitting display device.

11. The method of claim 10, further comprising:

transmitting, to the host device, the calculated first accumulated driving amount and the calculated second accumulated driving amount during a termination operation of the organic light emitting display device, wherein the transmitted first and second accumulated driving amounts are used as the first and second previous accumulated driving amounts during a subsequent initialization operation.

12. The method of claim 1, wherein the ratio of the first data to the second data with respect to the white portion of the input data is periodically adjusted.

13. The method of claim 12, wherein adjusting the ratio of the first data to the second data with respect to the white portion of the input data comprises:

counting a number of frames of the input data;

comparing the counted number of frames with a reference frame number; and when the counted number of frames is the same as the reference frame number, adjusting the ratio of the first data to the second data with respect to the white portion of the input data.

14. A method of operating an organic light emitting display device including a red sub-pixel, a green sub-pixel, a blue sub-pixel and a white sub-pixel, the method comprising:

increasing a first gamma voltage for the red, green and blue sub-pixels to increase a sum of maximum luminances of the red, green and blue sub-pixels;

decreasing a second gamma voltage for the white pixel to decrease a maximum luminance of the white sub-pixel;

calculating a ratio of a first accumulated driving amount of the red, green and blue sub-pixels to a second accumulated driving amount of the white sub-pixel;

determining a ratio of first data of the red, green and blue sub-pixels to second data of the white sub-pixel with respect to a white portion of RGB (red, green, blue) input data in inverse proportion to the ratio of the first accumulated driving amount to the second accumulated driving amount;

converting the RGB input data into RGBW (red, green, blue, white) data based on the ratio of the first data to the second data with respect to the white portion; and driving the red, green, blue and white sub-pixels based on the increased first gamma voltage, the decreased second gamma voltage and the RGBW data.

15. The method of claim 14, wherein increasing the first gamma voltage comprises:

increasing the first gamma voltage in inverse proportion to a ratio of an aperture size of the red, green and blue sub-pixels to an aperture size of a pixel.

16. The method of claim 14, wherein decreasing the second gamma voltage comprises:

decreasing the second gamma voltage in inverse proportion to a ratio of the maximum luminance of the white sub-pixel to the increased sum of the maximum luminances of the red, green and blue sub-pixels.

17. The method of claim 14, wherein calculating the ratio of the first accumulated driving amount to the second accumulated driving amount comprises:

calculating the first accumulated driving amount by accumulating a product of gray values of the red, green and blue sub-pixels, driving times of the red, green and blue sub-pixels and a ratio of the first gamma voltage after being adjusted to the first gamma voltage before being adjusted;

calculating the second accumulated driving amount by accumulating a product of a gray value of the white sub-pixel, a driving time of the white sub-pixel and a ratio of the second gamma voltage after being adjusted to the second gamma voltage before being adjusted; and calculating the ratio of the calculated first accumulated driving amount to the calculated second accumulated driving amount.

18. The method of claim 14, wherein calculating the ratio of the first accumulated driving amount to the second accumulated driving amount comprises:

reading a first previous accumulated driving amount of the red, green and blue sub-pixels and a second previous accumulated driving amount of the white sub-pixel from a nonvolatile memory device;

calculating the first accumulated driving amount by accumulating, in addition to the first previous accumulated driving amount, a product of gray values of the red, green and blue sub-pixels, driving times of the red, green and blue sub-pixels and a ratio of the first gamma voltage after being adjusted to the first gamma voltage before being adjusted;

calculating the second accumulated driving amount by accumulating, in addition to the second previous accumulated driving amount, a product of a gray value of the white sub-pixel, a driving time of the white sub-pixel and a ratio of the second gamma voltage after being adjusted to the second gamma voltage before being adjusted; and calculating the ratio of the calculated first accumulated driving amount to the calculated second accumulated driving amount.

19. The method of claim 14, wherein determining the ratio of the first data to the second data with respect to the white portion of the RGB input data comprises:

counting a number of frames of the RGB input data;

comparing the counted number of frames with a reference frame number; and when the counted number of frames is equal to the reference frame number, adjusting the ratio of the first data to the second data with respect to the white portion of the RGB input data.

20. A method of operating an organic light emitting display device including a red sub-pixel, a green sub-pixel, a blue sub-pixel and a white sub-pixel, the method comprising:

converting RGB (red, green, blue) input data received from a host device into RGBW (red, green, blue, white) data;

adjusting a first gamma voltage for the red, green and blue sub-pixels and a second gamma voltage for the white pixel based on a ratio of an aperture size of the red, green and blue sub-pixels to an aperture size of a pixel, a ratio of a maximum luminance of the white sub-pixel to a sum of maximum luminances of the red, green and blue sub-pixels, and a ratio of a first accumulated driving amount of the red, green and blue sub-pixels to a second accumulated driving amount of the white sub-pixel; and driving the red, green, blue and white sub-pixels based on the adjusted first gamma voltage, the adjusted second gamma voltage and the RGBW data.

21. The method of claim 20, wherein the first gamma voltage is adjusted in inverse proportion to the ratio of the aperture size of the red, green and blue sub-pixels to the aperture size of the pixel and in inverse proportion to the ratio of the first accumulated driving amount to the second accumulated driving amount.

22. The method of claim 20, wherein the second gamma voltage is adjusted in inverse proportion to the ratio of the maximum luminance of the white sub-pixel to the sum of the maximum luminances of the red, green and blue sub-pixels and in proportion to the ratio of the first accumulated driving amount to the second accumulated driving amount.

23. An organic light emitting display device, comprising:

a display panel including a red sub-pixel, a green sub-pixel, a blue sub-pixel and a white sub-pixel;

a gamma voltage generator configured to generate a first gamma voltage for the red, green and blue sub-pixels and a second gamma voltage for the white pixel, the first and second gamma voltages being adjusted such that a sum of maximum luminances of the red, green and blue sub-pixels is substantially equal to a luminance of a white color displayed by the organic light emitting display device;

a data converter configured to adjust, with respect to a white portion of RGB (red, green, blue) input data, a ratio of first data of the red, green and blue sub-pixels to second data of the white sub-pixel based on a first accumulated driving amount of the red, green and blue sub-pixels and a second accumulated driving amount of the white sub-pixel, and configured to convert the RGB input data into RGBW (red, green, blue, white) data based on the adjusted ratio of the first data to the second data; and a source driver configured to drive the red, green, blue and white sub-pixels based on the first gamma voltage, the second gamma voltage and the RGBW data.

24. The organic light emitting display device of claim 23, wherein the first gamma voltage and the second gamma voltage generated by the gamma voltage generator are adjusted such that the sum of the maximum luminances of the red, green and blue sub-pixels is substantially equal to a maximum luminance of the white sub-pixel.

25. The organic light emitting display device of claim 23, wherein the first gamma voltage generated by the gamma voltage generator is increased to increase the sum of the maximum luminances of the red, green and blue sub-pixels, and wherein the second gamma voltage generated by the gamma voltage generator is decreased to decrease the maximum luminance of the white sub-pixel.

26. The organic light emitting display device of claim 25, wherein the first gamma voltage generated by the gamma voltage generator is increased in inverse proportion to a ratio of an aperture size of the red, green and blue sub-pixels to an aperture size of a pixel, and wherein the second gamma voltage generated by the gamma voltage generator is decreased in inverse proportion to a ratio of the maximum luminance of the white sub-pixel to the increased sum of the maximum luminances of the red, green and blue sub-pixels.

27. The organic light emitting display device of claim 23, wherein the data converter comprises:

a data ratio determining unit configured to determine the ratio of the first data to the second data with respect to the white portion of the RGB input data in inverse proportion to the ratio of the first accumulated driving amount to the second accumulated driving amount; and an RGB-to-RGBW converting unit configured to convert the RGB input data into the RGBW data based on the ratio of the first data to the second data with respect to the white portion of the RGB input data.

28. The organic light emitting display device of claim 27, wherein the data ratio determining unit comprises:

a driving amount accumulating unit configured to calculate the first accumulated driving amount by accumulating a product of gray values of the red, green and blue sub-pixels, driving times of the red, green and blue sub-pixels and a ratio of the first gamma voltage after being adjusted to the first gamma voltage before being adjusted, and configured to calculate the second accumulated driving amount by accumulating a product of a gray value of the white sub-pixel, a driving time of the white sub-pixel and a ratio of the second gamma voltage after being adjusted to the second gamma voltage before being adjusted; and a data ratio calculating unit configured to receive the first accumulated driving amount and the second accumulated driving amount from the driving amount accumulating unit, and configured to calculate the ratio of the first data to the second data with respect to the white portion of the RGB input data in inverse proportion to the ratio of the first accumulated driving amount to the second accumulated driving amount.

29. The organic light emitting display device of claim 28, wherein the driving amount accumulating unit is configured to receive the first and second accumulated driving amounts stored in a nonvolatile memory device from a host device during an initialization operation of the organic light emitting display device, and is configured to transmit the first and second accumulated driving amounts to the host device to store the first and second accumulated driving amounts in the nonvolatile memory device during a termination operation of the organic light emitting display device.

30. The organic light emitting display device of claim 27, wherein the data converter comprises:

a frame counter configured to count a number of frames of the RGB input data in response to a vertical synchronization signal; and a comparator configured to compare the counted number of frames with a reference frame number, and configured to activate the data ratio determining unit when the counted number of frames is the same as the reference frame number.

* * * * *